US007980086B2

(12) United States Patent
Kotani et al.

(10) Patent No.: US 7,980,086 B2
(45) Date of Patent: Jul. 19, 2011

(54) AIR CONDITIONER

(75) Inventors: Takuya Kotani, Osaka (JP); Tadafumi Nishimura, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 455 days.

(21) Appl. No.: 12/161,753

(22) PCT Filed: Jan. 25, 2007

(86) PCT No.: PCT/JP2007/051138
§ 371 (c)(1),
(2), (4) Date: Jul. 22, 2008

(87) PCT Pub. No.: WO2007/086445
PCT Pub. Date: Aug. 2, 2007

(65) Prior Publication Data

US 2010/0223940 A1 Sep. 9, 2010

(30) Foreign Application Priority Data

Jan. 25, 2006 (JP) ..... 2006-015817

(51) Int. Cl.
*F25B 45/00* (2006.01)
*F25B 49/00* (2006.01)

(52) U.S. Cl. ..... 62/149; 62/77; 62/127; 62/292

(58) Field of Classification Search ..... 62/77, 127, 62/129, 149, 292
See application file for complete search history.

(56) References Cited

U.S. PATENT DOCUMENTS

| | | | | |
|---|---|---|---|---|
| 6,220,041 | B1 * | 4/2001 | Okazaki et al. | 62/149 |
| 7,752,855 | B2 * | 7/2010 | Matsuoka et al. | 62/149 |
| 2009/0126375 | A1 | 5/2009 | Toyoshima et al. | |

FOREIGN PATENT DOCUMENTS

| | | | |
|---|---|---|---|
| JP | S56-163266 | U | 5/1980 |
| JP | S63-011576 | Y2 | 12/1981 |
| JP | 63011576 | * | 4/1988 |
| JP | H08-200905 | A | 8/1996 |
| JP | 2002-195705 | A | 7/2002 |
| JP | 2005-114184 | A | 4/2005 |
| JP | 2007-127326 | A | 5/2007 |
| WO | WO-2007/049372 | A1 | 5/2007 |

* cited by examiner

*Primary Examiner* — Marc E Norman
(74) *Attorney, Agent, or Firm* — Global IP Counselors

(57) ABSTRACT

An air conditioner is provided that is capable of allowing an operator to know, during a refrigerant charging operation using a cylinder, that the refrigerant cylinder is emptied without using a scale or the like. An air conditioner in which the refrigerant is charged using a cylinder containing the refrigerant includes a refrigerant circuit, a charge port, a downstream temperature sensor, an outdoor side controller, and a display unit. The refrigerant circuit is configured by the interconnection of a compressor, an outdoor side heat exchanger, an indoor side expansion valve, and an indoor side heat exchanger. The charge port is a port for charging the refrigerant into the refrigerant circuit from the cylinder. The downstream temperature sensor is provided in the vicinity of the charge port of the refrigerant circuit. The outdoor side controller judges whether or not the cylinder is emptied based on a change in at least one of a temperature detected by the downstream temperature sensor or a superheating degree. The display unit performs output when it is judged by the outdoor side controller that the cylinder is emptied.

12 Claims, 17 Drawing Sheets

AIR CONDITIONER

CROSS-REFERENCE TO RELATED APPLICATIONS

This U.S. National stage application claims priority under 35 U.S.C. §119(a) to Japanese Patent Application No. 2006-015817, filed in Japan on Jan. 25, 2006, the entire contents of which are hereby incorporated herein by reference.

TECHNICAL FIELD

The present invention relates to a function to judge the refrigerant quantity in a refrigerant circuit of an air conditioner. More specifically, the present invention relates to a function to judge the refrigerant quantity in a refrigerant circuit of an air conditioner configured by the interconnection of a compressor, a heat source side heat exchanger, an expansion mechanism, and a utilization side heat exchanger.

BACKGROUND ART

Conventionally, for example, as shown in JP-A Publication No. 08-200905 as below, at a site where an air conditioner is installed, an operation to charge refrigerant according to the capacity of each installed equipment is performed before adjusting the air conditioner through the test operation. In this air conditioner, the refrigerant quantity to be additionally charged is automatically calculated and displayed by using information on the diameter, length, and the like of a pipe that is used for connection. In addition, such refrigerant charging is performed not only at the time of installation as described above but also at the time of re-charging in case of a refrigerant leak, re-charging after troubleshooting, and the like.

SUMMARY OF THE INVENTION

Object to be Achieved by the Invention

Incidentally, with the air conditioner disclosed in JP-A Publication No. 08-200905, an operator performs a refrigerant charging operation by recognizing the additional refrigerant charging amount which is automatically calculated and displayed. Additionally, for example, when performing the charging operation into the refrigerant circuit by using the refrigerant contained in a cylinder, the operator sometimes charges refrigerant using a plurality of cylinders in order to charge the recognized additional charging amount. In such a case, when the cylinder is emptied, the cylinder needs to be replaced with a new cylinder. Accordingly, the operator occasionally checks the change in the weight of the cylinder using a scale or the like in order to perform the charging operation.

The present invention is made in view of the above described circumstance. An object of the present invention is to provide an air conditioner capable of allowing an operator to know, during a refrigerant charging operation using a cylinder, that the cylinder is in an empty state without using a scale or the like.

Means to Achieve the Object

An air conditioner according to a first aspect of the present invention is an air conditioner in which the refrigerant is charged using a cylinder containing the refrigerant, the air conditioner including a refrigerant circuit, a charge port, a first temperature sensor, a charge judging unit, and an output unit. The refrigerant circuit is configured by the interconnection of a compressor, a heat source side heat exchanger, a utilization side expansion valve, and a utilization side heat exchanger. The charge port is a port for charging the refrigerant into the refrigerant circuit from the cylinder. The first temperature sensor is provided in the vicinity of the charge port of the refrigerant circuit. The charge judging unit judges whether or not the cylinder is emptied based on a change in at least one of a temperature detected by the first temperature sensor or a superheating degree. The output unit performs output when the charge judging unit judges that the cylinder is emptied. Outputs by the output unit here include, for example, lighting the LEDs, generating a sound from a speaker or the like, and displaying on a display device.

With the conventional air conditioner, sometimes a situation occurs where the cylinder is emptied during the refrigerant charging operation and the cylinder needs to be replaced with a new cylinder in order to continue charging. In such a case, in order to judge whether or not the cylinder is emptied, the operator needs to occasionally check the change in the weight of the cylinder using a scale or the like.

As a countermeasure, the air conditioner according to the first aspect of the present invention has the first temperature sensor provided in the vicinity of the charge port of the refrigerant into the refrigerant circuit, so that it is possible to detect the start of charging of refrigerant from the cylinder as a change in the temperature of the refrigerant flowing in the refrigerant circuit. Note that the temperature sensor here is preferably provided in the vicinity of the charge port of the refrigerant circuit and also on the downstream side thereof in order to reliably detect a change in the temperature. Additionally, the charge judging unit judges whether or not the cylinder is emptied based on a change in at least one of the temperature detected by the first temperature sensor or the superheating degree. Then, the output unit performs output when the charge judging unit judges that the cylinder is emptied. Accordingly, the operator who charges the refrigerant into the refrigerant circuit using the cylinder can easily know that the cylinder is emptied based on an output result from the output unit.

Accordingly, the operator who performs refrigerant charging does not need to weigh the cylinder on a scale or the like during the charging operation and can know, without paying particular attention, that the cylinder is emptied based on information obtained from the output unit.

An air conditioner according to a second aspect of the present invention is the air conditioner according to the first aspect of the present invention, wherein the charge judging unit judges that the cylinder is emptied when a value relating to at least one of the temperature degree detected by the first temperature sensor or the superheating became equal to or greater than a predetermined judgment value. The predetermined judgment value here may be, for example, a value reflecting a target superheating degree of the refrigerant in the vicinity of an outlet of the utilization side heat exchanger, a value taking into consideration the correction amount with respect to the effect of the outdoor air temperature, or a threshold value for the rate of change in the temperature detected by the first temperature sensor or the superheating degree. In addition, a related value here includes, for example, a rate of change of the change in the temperature or in the superheating degree per unit time, and the like.

Here, the charge judging unit judges whether or not a value relating to either the temperature or the superheating degree became equal to or greater than the predetermined judgment value. Accordingly, the charge judging unit can judge whether or not the refrigerant is in a superheated state, so that it can be judged that the cylinder is emptied when the refrigerant is in a superheated state.

Accordingly, it is possible to more reliably judge that the cylinder is empty.

An air conditioner according to a third aspect of the present invention is the air conditioner according to the first or the second aspect of the present invention, wherein the charge port is provided between the utilization side heat exchanger and the compressor of the refrigerant circuit. The first temperature sensor is provided between the charge port and the compressor.

Here, because the first temperature sensor is provided between the charge port and the compressor, it is possible to reliably know the superheating degree of the refrigerant. In addition, because the first temperature sensor is disposed between the charge port and the compressor, it is possible to reliably know the temperature of the refrigerant on the downstream side after being charged from the cylinder.

Accordingly, it is possible to more reliably judge that the cylinder is empty.

An air conditioner according to a fourth aspect of the present invention is the air conditioner according to any one of the first through third aspects of the present invention, wherein the first temperature sensor is provided on the downstream side between the charge port and the compressor. In addition, the air conditioner is further provided with a second temperature sensor provided on the upstream side with respect to the charge port. Here, the charge judging unit makes a judgment based on the difference between the temperatures or between the superheating degrees detected by the first temperature sensor and by the second temperature sensor, or a change in the difference between the temperatures or between the superheating degrees.

Here, a change in the temperature of the refrigerant flowing in the refrigerant circuit, which is caused as the refrigerant is charged from the cylinder, is detected at two positions, i.e., at the upstream side with respect to the charge port and at downstream side with respect to the charge port. Thus, it is possible to compare the refrigerant temperature before the refrigerant from the cylinder is mixed with the refrigerant temperature after the refrigerant from the cylinder is mixed. In addition, accordingly, it is possible to compare the superheating degree of the refrigerant before the refrigerant from the cylinder is mixed with the superheating degree of the refrigerant after the refrigerant from the cylinder is mixed.

Accordingly, when a value of the state quantity at the upstream of the charge port became equal to a value of the state quantity at the downstream of the charge port, it can be judged that refrigerant charging from the cylinder is completed, and it is possible to more accurately detect that the cylinder is emptied.

An air conditioner according to a fifth aspect of the present invention is the air conditioner according to the first or second aspect of the present invention, wherein the first temperature sensor is provided between the cylinder and the charge port. Note that as a crossing point between the cylinder and the charge port here, for example, a crossing point between the cylinder and a branching point of the main refrigerant circuit is also included in the case where the refrigerant is charged from the cylinder using a pipe branched from a main refrigerant circuit.

Here, the first temperature sensor detects the temperature of the refrigerant supplied from the cylinder to the charge port, instead the temperature at the midway of the main refrigerant circuit, so that the detection is less affected by the flow rate and the temperature of the refrigerant in the main refrigerant circuit. Further, in the refrigerant charging process from the cylinder into the main refrigerant circuit, it is possible to estimate the amount of residual refrigerant in the cylinder according to the temperature of the refrigerant flowing from the cylinder to the charge port in the case where the detected temperature changes as charging advances from the start of charging.

Accordingly, it is possible to detect an empty state of the cylinder simply by a configuration in which a portion from the cylinder to the charge port is independent from the main refrigerant circuit.

An air conditioner according to a sixth aspect of the present invention is the air conditioner according to any one of the first through fifth aspects of the present invention, further including a state quantity detection sensor and a refrigerant quantity judging means. The state quantity detection sensor detects the state quantity of the refrigerant in the refrigerant circuit. Then, the refrigerant quantity judging means judges whether or not a predetermined amount of refrigerant has been charged into the refrigerant circuit based on a change in the state quantity detected by the state quantity detection sensor. Here, the state quantity to be detected by the state quantity detection sensor includes, for example, the temperature or the superheating degree of the refrigerant in the refrigerant circuit, the rate of change of these values, or the like. Note that the state quantity detection sensor used here may be a sensor that also serves as the above described first temperature sensor.

Here, whether or not the predetermined amount of refrigerant has been charged into the refrigerant circuit can be judged by the state quantity detection sensor and the refrigerant quantity judging means. Accordingly, not only that the operation to detect the empty state of the cylinder using a scale becomes unnecessary and the empty state of the cylinder can be known automatically; but also that the operation to detect that a necessary amount of refrigerant has been charged into the refrigerant circuit by using a scale becomes unnecessary and it can be known automatically.

Accordingly, the operator can complete the charging operation of a necessary amount of refrigerant into the refrigerant circuit simply by knowing the empty state of the cylinder and replacing the cylinder with a new cylinder.

EFFECT OF THE INVENTION

With the air conditioner according to the first aspect of the present invention, the operator who performs refrigerant charging does not need to weigh the cylinder on a scale or the like during the charging operation and can know, without paying particular attention, that the cylinder is emptied based on information obtained from the output unit.

With the air conditioner according to the second aspect of the present invention, it is possible to more reliably judge whether or not the cylinder is emptied.

With the air conditioner according to the third aspect of the present invention, it is possible to even more reliably judge that the cylinder is emptied.

With the air conditioner according to the fourth aspect of the present invention, when a value of the state quantity at the upstream of the charge port became equal to a value of the state quantity at the downstream of the charge port, it can be judged that the refrigerant charging from the cylinder is completed, and it is possible to more accurately detect that the cylinder is emptied.

With the air conditioner according to the fifth aspect of the present invention, it is possible to detect the empty state of the cylinder simply by a configuration in which a portion from the cylinder to the charge port is independent from the main refrigerant circuit.

With the air conditioner according to the sixth aspect of the present invention, the operator can complete the charging operation of a necessary amount of refrigerant into the refrigerant circuit simply by knowing the empty state of the cylinder and replacing the cylinder with a new cylinder.

DETAILED DESCRIPTION OF THE INVENTION

Overview of the Invention

The present invention provides an air conditioner in which the refrigerant is charged into a refrigerant circuit using a cylinder.

With the air conditioner of the present invention, the timing when the cylinder becomes empty is specified based on the refrigerant temperature or the superheating degree in the vicinity of a charge port, which changes as the refrigerant is charged into the refrigerant circuit from the cylinder via the charge port. Accordingly, the present invention is characterized in that the burden on the operator who charges the refrigerant into the refrigerant circuit using a cylinder is reduced.

Below, an embodiment of an air conditioner according to the present invention is described based on the drawings.

(1) Configuration of the Air Conditioner

Figure 1:
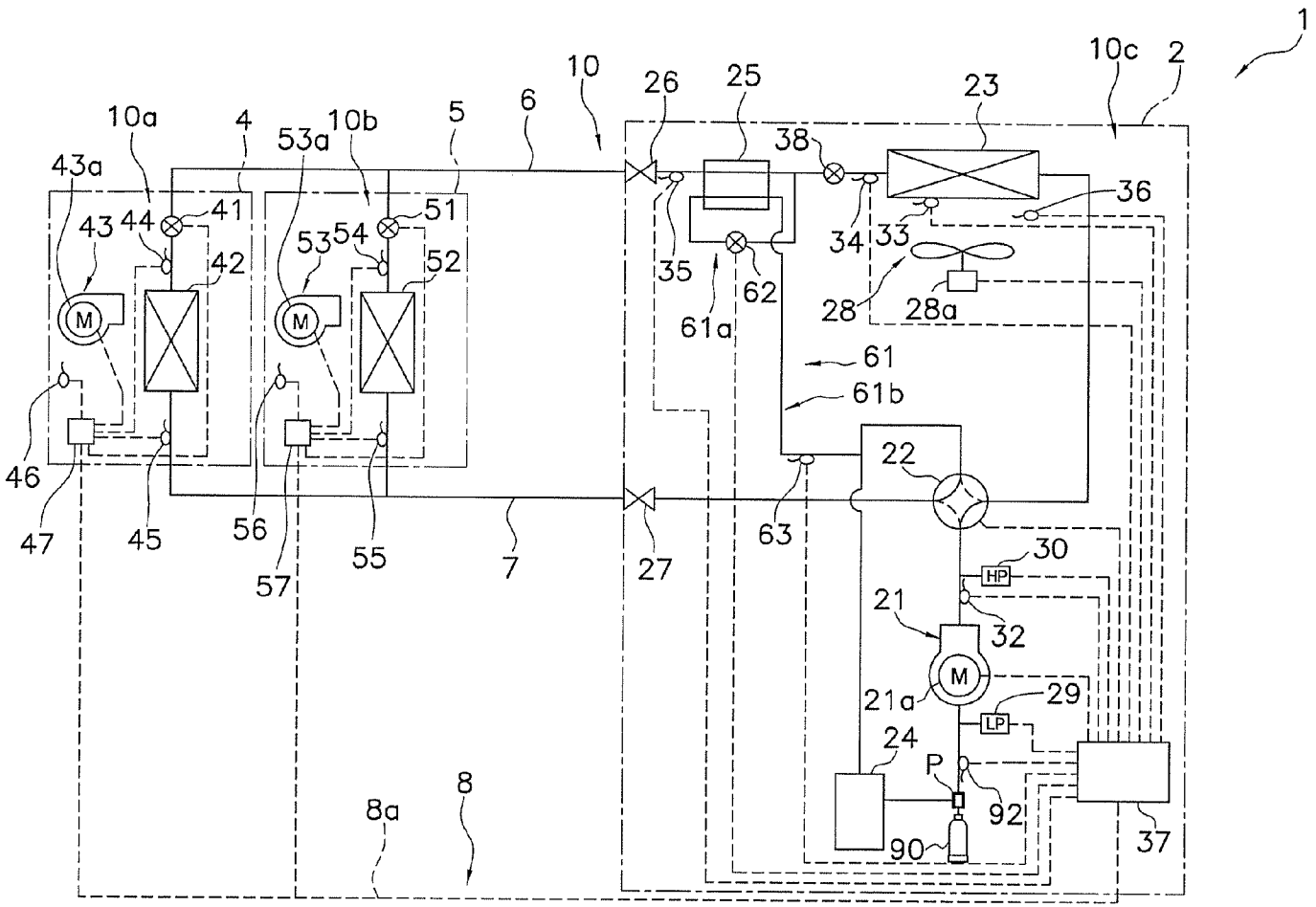
FIG. 1 is a schematic refrigerant circuit diagram of an air conditioner according to an embodiment of the present invention.

FIG. 1 is a schematic configuration view of an air conditioner 1 according to an embodiment of the present invention. The air conditioner 1 is a device that is used to cool and heat a room in a building and the like by performing a vapor compression-type refrigeration cycle operation. The air conditioner 1 mainly includes one outdoor unit 2 as a heat source unit, indoor units 4 and 5 as a plurality (two in the present embodiment) of utilization units connected in parallel thereto, and a liquid refrigerant communication pipe 6 and a gas refrigerant communication pipe 7 as refrigerant communication pipes which interconnect the outdoor unit 2 and the indoor units 4 and 5. In other words, a vapor compression-type refrigerant circuit 10 of the air conditioner 1 in the present embodiment is configured by the interconnection of the outdoor unit 2, the indoor units 4 and 5, and the liquid refrigerant communication pipe 6 and the gas refrigerant communication pipe 7.

As shown in FIG. 1, after the outdoor unit 2, the indoor units 4 and 5, the liquid refrigerant communication pipe 6, and the gas refrigerant communication pipe 7 are interconnected, the refrigerant flowing in the refrigerant circuit 10 is replenished from a refrigerant cylinder 90 in which the refrigerant is contained in order to replenish the shortage.

<Indoor Unit>

The indoor units 4 and 5 are installed by being embedded in or hung from a ceiling of a room in a building and the like or by being mounted or the like on a wall surface of a room. The indoor units 4 and 5 are connected to the outdoor unit 2 via the liquid refrigerant communication pipe 6 and the gas refrigerant communication pipe 7, and configure a part of the refrigerant circuit 10.

Next, the configurations of the indoor units 4 and 5 are described. Note that, because the indoor units 4 and 5 have the same configuration, only the configuration of the indoor unit 4 is described here, and in regard to the configuration of the indoor unit 5, reference numerals in the 50s are used instead of reference numerals in the 40s representing the respective portions of the indoor unit 4, and description of those respective portions are omitted.

The indoor unit 4 mainly includes an indoor side refrigerant circuit 10*a* (an indoor side refrigerant circuit 10*b* in the case of the indoor unit 5) that configures a part of the refrigerant circuit 10. The indoor side refrigerant circuit 10*a* mainly includes an indoor expansion valve 41 as an expansion mechanism and an indoor heat exchanger 42 as a utilization side heat exchanger.

In the present embodiment, the indoor expansion valve 41 is an electrically powered expansion valve connected to a liquid side of the indoor heat exchanger 42 in order to adjust the flow rate or the like of the refrigerant flowing in the indoor side refrigerant circuit 10*a*.

In the present embodiment, the indoor heat exchanger 42 is a cross fin-type fin-and-tube type heat exchanger configured by a heat transfer tube and numerous fins, and is a heat exchanger that functions as an evaporator for the refrigerant during a cooling operation to cool the room air and functions as a condenser for the refrigerant during a heating operation to heat the room air.

In the present embodiment, the indoor unit 4 includes an indoor fan 43 as a ventilation fan for taking in room air into the unit, causing the air to heat exchange with the refrigerant in the indoor heat exchanger 42, and then supplying the air to the room as supply air. The indoor fan 43 is a fan capable of varying an air flow rate Wr of the air which is supplied to the indoor heat exchanger 42, and in the present embodiment, is a centrifugal fan, multi-blade fan, or the like, which is driven by a motor 43*a* comprising a DC fan motor.

In addition, various types of sensors are disposed in the indoor unit 4. A liquid side temperature sensor 44 that detects the temperature of the refrigerant (i.e., the refrigerant temperature corresponding to a condensation temperature Tc during the heating operation or an evaporation temperature Te during the cooling operation) is disposed at the liquid side of the indoor heat exchanger 42. A gas side temperature sensor 45 that detects a temperature Teo of the refrigerant is disposed at a gas side of the indoor heat exchanger 42. A room temperature sensor 46 that detects the temperature of the room air that flows into the unit (i.e., a room temperature Tr) is disposed at a room air intake side of the indoor unit 4. In the present embodiment, the liquid side temperature sensor 44, the gas side temperature sensor 45, and the room temperature sensor 46 comprise thermistors. In addition, the indoor unit 4 includes an indoor side controller 47 that controls the operation of each portion constituting the indoor unit 4. Additionally, the indoor side controller 47 includes a microcomputer and a memory and the like disposed in order to control the indoor unit 4, and is configured such that it can exchange control signals and the like with a remote controller (not shown) for individually operating the indoor unit 4 and can exchange control signals and the like with the outdoor unit 2 via a transmission line 8*a*.

<Outdoor Unit>

The outdoor unit 2 is installed on the roof or the like of a building and the like, is connected to the indoor units 4 and 5 via the liquid refrigerant communication pipe 6 and the gas refrigerant communication pipe 7, and configures the refrigerant circuit 10 with the indoor units 4 and 5.

Next, the configuration of the outdoor unit 2 is described. The outdoor unit 2 mainly includes an outdoor side refrigerant circuit 10*c* that configures a part of the refrigerant circuit 10. This outdoor side refrigerant circuit 10*c* mainly includes a compressor 21, a four-way switching valve 22, an outdoor heat exchanger 23 as a heat source side heat exchanger, an outdoor expansion valve 38 as an expansion mechanism, an accumulator 24, a liquid side stop valve 26, and a gas side stop valve 27, and a charge port P for charging refrigerant from the above described refrigerant cylinder 90 into the refrigerant circuit 10.

The compressor 21 is a compressor whose operation capacity can be varied, and in the present embodiment, is a positive displacement-type compressor driven by a motor 21*a* whose rotation frequency Rm is controlled by an inverter. In the present embodiment, only one compressor 21 is provided, but it is not limited thereto, and two or more compressors may be connected in parallel according to the number of connected units of indoor units and the like.

The four-way switching valve 22 is a valve for switching the direction of the flow of the refrigerant such that, during the cooling operation, the four-way switching valve 22 is capable of connecting a discharge side of the compressor 21 and a gas side of the outdoor heat exchanger 23 and connecting a suction side of the compressor 21 (specifically, the accumulator 24) and the gas refrigerant communication pipe 7 (see the solid lines of the four-way switching valve 22 in FIG. 1) to cause the outdoor heat exchanger 23 to function as a condenser for the refrigerant compressed in the compressor 21 and to cause the indoor heat exchangers 42 and 52 to function as evaporators for the refrigerant condensed in the outdoor heat exchanger 23; and such that, during the heating operation, the four-way switching valve 22 is capable of connecting the discharge side of the compressor 21 and the gas refrigerant communication pipe 7 and connecting the suction side of the compressor 21 and the gas side of the outdoor heat exchanger 23 (see the dotted lines of the four-way switching valve 22 in FIG. 1) to cause the indoor heat exchangers 42 and 52 to function as condensers for the refrigerant compressed in the compressor 21 and to cause the outdoor heat exchanger 23 to function as an evaporator for the refrigerant condensed in the indoor heat exchangers 42 and 52.

In the present embodiment, the outdoor heat exchanger 23 is a cross-fin type fin-and-tube type heat exchanger configured by a heat transfer tube and numerous fins, and is a heat exchanger that functions as a condenser for the refrigerant during the cooling operation and as an evaporator for the refrigerant during the heating operation. The gas side of the outdoor heat exchanger 23 is connected to the four-way switching valve 22, and the liquid side thereof is connected to the liquid refrigerant communication pipe 6.

In the present embodiment, the outdoor expansion valve 38 is an electrically powered expansion valve connected to a liquid side of the outdoor heat exchanger 23 in order to adjust the pressure, flow rate, or the like of the refrigerant flowing in the outdoor side refrigerant circuit 10*c*.

In the present embodiment, the outdoor unit 2 includes an outdoor fan 28 as a ventilation fan for taking in outdoor air into the unit, causing the air to exchange heat with the refrigerant in the outdoor heat exchanger 23, and then exhausting the air to the outside. The outdoor fan 28 is a fan capable of varying an air flow rate Wo of the air which is supplied to the outdoor heat exchanger 23, and in the present embodiment, is a propeller fan or the like driven by a motor 28*a* comprising a DC fan motor.

The accumulator 24 is connected between the four-way switching valve 22 and the compressor 21, and is a container capable of accumulating excess refrigerant generated in the refrigerant circuit 10 in accordance with the change in the operation load of the indoor units 4 and 5 and the like.

In the present embodiment, the subcooler 25 is a double tube heat exchanger, and is disposed to cool the refrigerant sent to the indoor expansion valves 41 and 51 after the refrigerant is condensed in the outdoor heat exchanger 23. In the present embodiment, the subcooler 25 is connected between the outdoor expansion valve 38 and the liquid side stop valve 26.

In the present embodiment, a bypass refrigerant circuit 61 as a cooling source of the subcooler 25 is disposed. Note that, in the description below, a portion corresponding to the refrigerant circuit 10 excluding the bypass refrigerant circuit 61 is referred to as a main refrigerant circuit for convenience sake.

The bypass refrigerant circuit 61 is connected to the main refrigerant circuit so as to cause a portion of the refrigerant sent from the outdoor heat exchanger 23 to the indoor expansion valves 41 and 51 to branch from the main refrigerant circuit and return to the suction side of the compressor 21. Specifically, the bypass refrigerant circuit 61 includes a branch circuit 61*a* connected so as to branch a portion of the refrigerant sent from the outdoor expansion valve 38 to the indoor expansion valves 41 and 51 at a position between the outdoor heat exchanger 23 and the subcooler 25, and a merging circuit 61*b* connected to the suction side of the compressor 21 so as to return a portion of refrigerant from an outlet on a bypass refrigerant circuit side of the subcooler 25 to the suction side of the compressor 21. Further, the branch circuit 61*a* is disposed with a bypass expansion valve 62 for adjusting the flow rate of the refrigerant flowing in the bypass refrigerant circuit 61. Here, the bypass expansion valve 62 comprises an electrically operated expansion valve. In this way, the refrigerant sent from the outdoor heat exchanger 23 to the indoor expansion valves 41 and 51 is cooled in the subcooler 25 by the refrigerant flowing in the bypass refrigerant circuit 61 which has been depressurized by the bypass expansion valve 62. In other words, performance of the subcooler 25 is controlled by adjusting the opening degree of the bypass expansion valve 62.

The liquid side stop valve 26 and the gas side stop valve 27 are valves disposed at ports connected to external equipment and pipes (specifically, the liquid refrigerant communication pipe 6 and the gas refrigerant communication pipe 7). The liquid side stop valve 26 is connected to the outdoor heat exchanger 23. The gas side stop valve 27 is connected to the four-way switching valve 22.

As described above, the charge port P is a connection port for charging refrigerant into the refrigerant circuit 10 from the refrigerant cylinder 90 in which the refrigerant is contained, and the refrigerant is charged as the refrigerant cylinder 90 is connected to the charge port P via a pipe.

In addition, various sensors are disposed in the outdoor unit 2.

Specifically, disposed in the outdoor unit 2 are an suction pressure sensor 29 that detects a suction pressure Ps of the compressor 21, a discharge pressure sensor 30 that detects a discharge pressure Pd of the compressor 21, a downstream temperature sensor 92 as a suction temperature sensor that detects a suction temperature Ts of the compressor 21, and a discharge temperature sensor 32 that detects a discharge temperature Td of the compressor 21. The downstream temperature sensor 92 is disposed at a position between the accumulator 24 and the compressor 21. A heat exchanger temperature sensor 33 that detects the temperature of the refrigerant flowing through the outdoor heat exchanger 23 (i.e., the refrigerant temperature corresponding to the condensation temperature Tc during the cooling operation or the evaporation temperature Te during the heating operation) is disposed in the outdoor heat exchanger 23. A liquid side temperature sensor 34 that detects a refrigerant temperature Tco is disposed at the liquid side of the outdoor heat exchanger 23. A liquid pipe temperature sensor 35 that detects the temperature of the refrigerant (i.e., a liquid pipe temperature Tlp) is disposed at the outlet on the main refrigerant circuit side of the subcooler 25. The merging circuit 61*b* of the bypass refrigerant circuit 61 is disposed with a bypass temperature sensor 63 for detecting the temperature of the refrigerant flowing through the outlet on the bypass refrigerant circuit side of the subcooler 25. An outdoor temperature sensor 36 that detects the temperature of the outdoor air that flows into the unit (i.e., an outdoor temperature Ta) is disposed at an outdoor air intake side of the outdoor unit 2.

Figure 11:
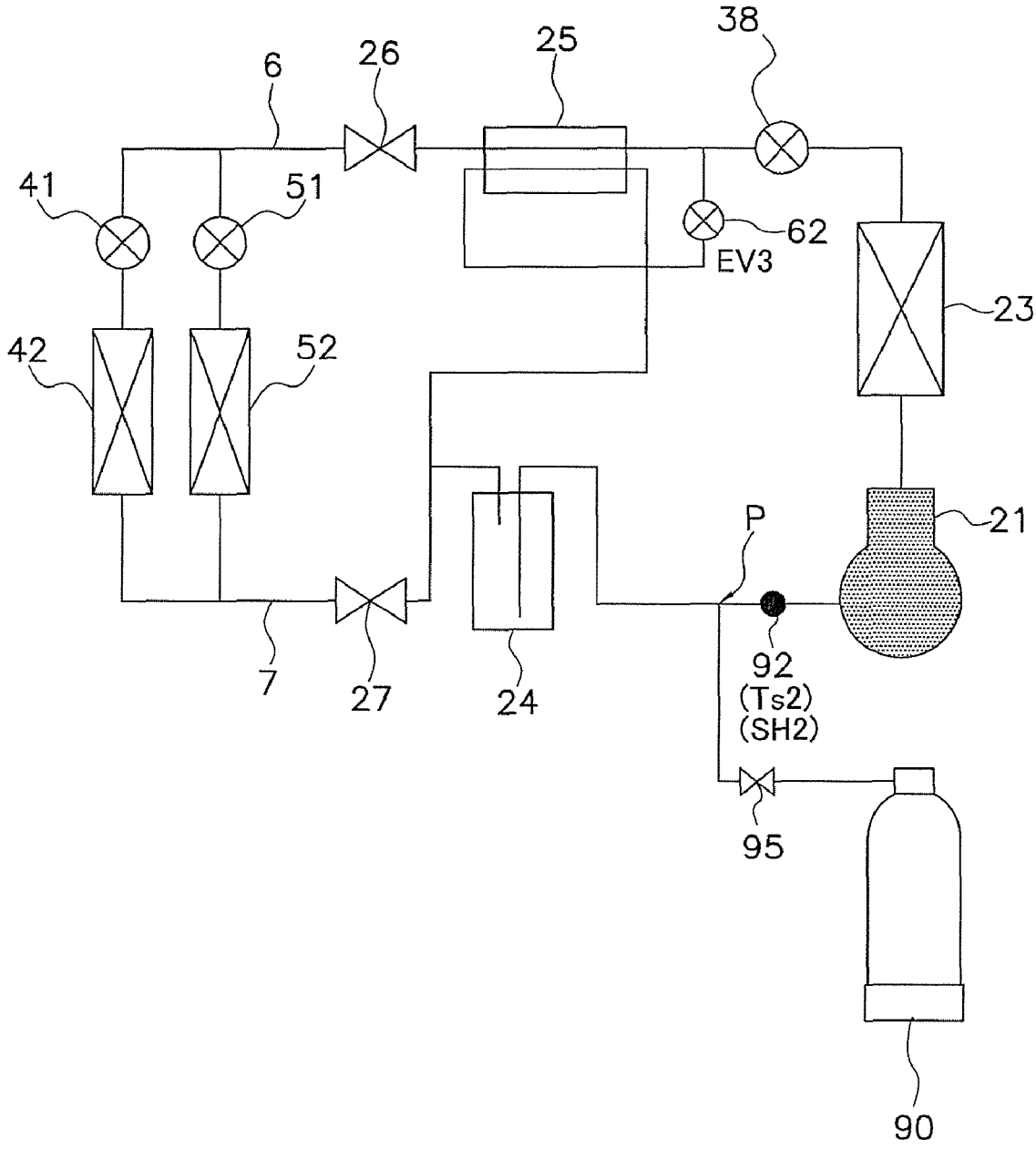
FIG. 11 is a schematic refrigerant circuit diagram in which the air conditioner is connected to the cylinder.

In addition, as shown in FIG. 11, the downstream temperature sensor 92 of the refrigerant circuit 10 is disposed on the downstream side of the compressor 21 side when seen from the charge port P. Here, the refrigerant cylinder 90 is connectable to the charge port P via a pipe, and a cylinder on/off valve 95 is provided to this pipe. Refrigerant charging from the refrigerant cylinder 90 is performed by opening and closing the cylinder on/off valve 95.

Note that, in the present embodiment, the downstream temperature sensor 92, the discharge temperature sensor 32, the heat exchanger temperature sensor 33, the liquid side temperature sensor 34, the liquid pipe temperature sensor 35, the outdoor temperature sensor 36, and the bypass temperature sensor 63 comprise thermistors.

In addition, the outdoor unit 2 includes an outdoor side controller 37 that controls the operation of each portion constituting the outdoor unit 2. Additionally, the outdoor side controller 37 includes a microcomputer and a memory disposed in order to control the outdoor unit 2, an inverter circuit that controls the motor 21*a*, and the like, and is configured such that it can exchange control signals and the like with the indoor side controllers 47 and 57 of the indoor units 4 and 5 via the transmission line 8*a*. In other words, a controller 8 that performs the operation control of the entire air conditioner 1 is configured by the indoor side controllers 47 and 57, the outdoor side controller 37, and the transmission line 8*a* that interconnects the outdoor-side controller 37 and the indoor-side controllers 47, and 57.

Figure 2:
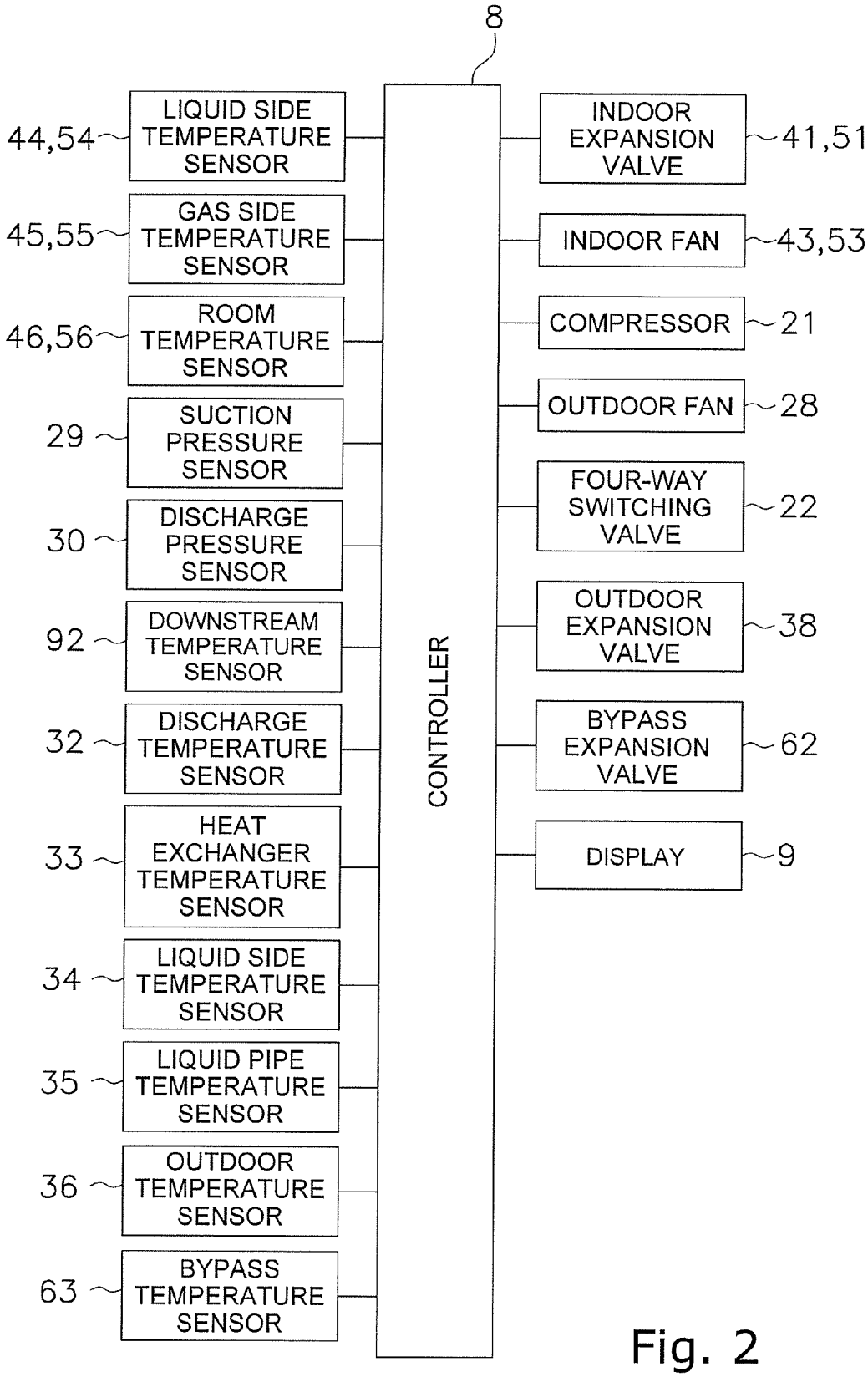
FIG. 2 is a control block diagram of the air conditioner.

As shown in FIG. 2, the controller 8 is connected so as to be able to receive detection signals of various sensors 29 to 36, 44 to 46, 54 to 56, 63, and 92 and also to be able to control various equipment and valves 21, 22, 24, 28*a*, 38, 41, 43*a*, 51, 53*a*, and 62 based on these detection signals and the like. In addition, a display unit 9 comprising LEDs and the like, which is configured to indicate that a refrigerant leak is detected in the below described refrigerant leak detection operation, is connected to the controller 8. Here, FIG. 2 is a control block diagram of the air conditioner 1.

<Refrigerant Communication Pipe>

The refrigerant communication pipes 6 and 7 are refrigerant pipes that are arranged on site when installing the air conditioner 1 at an installation location such as a building. As the refrigerant communication pipes 6 and 7, pipes having various lengths and pipe diameters are used according to the installation conditions such as an installation location, combination of an outdoor unit and an indoor unit, and the like. Accordingly, for example, when installing a new air conditioner, in order to calculate the refrigerant charging amount, it is necessary to obtain accurate information regarding the lengths and pipe diameters and the like of the refrigerant communication pipes 6 and 7. However, management of such information and the calculation itself of the refrigerant quantity are difficult. In addition, when utilizing an existing pipe to renew an indoor unit and an outdoor unit, information regarding the lengths and pipe diameters and the like of the refrigerant communication pipes 6 and 7 may have been lost in some cases.

As described above, the refrigerant circuit 10 of the air conditioner 1 is configured by the interconnection of the indoor side refrigerant circuits 10*a* and 10*b*, the outdoor side refrigerant circuit 10*c*, and the refrigerant communication pipes 6 and 7. In addition, it can also be said that this refrigerant circuit 10 is configured by the bypass refrigerant circuit 61 and the main refrigerant circuit excluding the bypass refrigerant circuit 61. Additionally, the controller 8 constituted by the indoor side controllers 47 and 57 and the outdoor side controller 37 allows the air conditioner 1 in the present embodiment to switch and operate between the cooling operation and the heating operation by the four-way switching valve 22 and to control each equipment of the outdoor unit 2 and the indoor units 4 and 5 according to the operation load of each of the indoor units 4 and 5.

(2) Operation of the Air Conditioner

Next, the operation of the air conditioner 1 in the present embodiment is described.

The operation modes of the air conditioner 1 in the present embodiment include: a normal operation mode where control of constituent equipment of the outdoor unit 2 and the indoor units 4 and 5 is performed according to the operation load of each of the indoor units 4 and 5; a test operation mode where a test operation to be performed after installation of constituent equipment of the air conditioner 1 is performed (specifically, it is not limited to after the first installation of equipment: it also includes, for example, after modification by adding or removing constituent equipment such as an indoor unit, after repair of damaged equipment); and a refrigerant leak detection operation mode where, after the test operation is finished and the normal operation has started, whether or not the refrigerant is leaking from the refrigerant circuit 10 is judged. The normal operation mode mainly includes the cooling operation for cooling the room and the heating operation for heating the room. In addition, the test operation mode mainly includes an automatic refrigerant charging operation to charge refrigerant into the refrigerant circuit 10; a pipe volume judging operation to detect the volumes of the refrigerant communication pipes 6 and 7; and an initial refrigerant quantity detection operation to detect the initial refrigerant quantity after installing constituent equipment or after charging refrigerant into the refrigerant circuit.

Operation in each operation mode of the air conditioner 1 is described below.

<Normal Operation Mode>

(Cooling Operation)

First, the cooling operation in the normal operation mode is described with reference to FIGS. 1 and 2.

During the cooling operation, the four-way switching valve 22 is in the state represented by the solid lines in FIG. 1, i.e., a state where the discharge side of the compressor 21 is connected to the gas side of the outdoor heat exchanger 23 and also the suction side of the compressor 21 is connected to the gas sides of the indoor heat exchangers 42 and 52 via the gas side stop valve 27 and the gas refrigerant communication pipe 7. The outdoor expansion valve 38 is in a fully opened state. The liquid side stop valve 26 and the gas side stop valve 27 are in an opened state. The opening degree of each of the indoor expansion valves 41 and 51 is adjusted such that a superheating degree SHr of the refrigerant at the outlets of the indoor heat exchangers 42 and 52 (i.e., the gas sides of the indoor heat exchangers 42 and 52) becomes constant at a target superheating degree SHrs. In the present embodiment, the superheating degree SHr of the refrigerant at the outlet of each of the indoor heat exchangers 42 and 52 is detected by subtracting the refrigerant temperature (which corresponds to the evaporation temperature Te) detected by the liquid side temperature sensors 44 and 54 from the refrigerant temperature detected by the gas side temperature sensors 45 and 55, or is detected by converting the suction pressure Ps of the compressor 21 detected by the suction pressure sensor 29 to saturated temperature corresponding to the evaporation temperature Te, and subtracting this saturated temperature of the refrigerant from the refrigerant temperature detected by the gas side temperature sensors 45 and 55. Note that, although it is not employed in the present embodiment, a temperature sensor that detects the temperature of the refrigerant flowing through each of the indoor heat exchangers 42 and 52 may be disposed such that the superheating degree SHr of the refrigerant at the outlet of each of the indoor heat exchangers 42 and 52 is detected by subtracting the refrigerant temperature corresponding to the evaporation temperature Te which is detected by this temperature sensor from the refrigerant temperature detected by the gas side temperature sensors 45 and 55. In addition, the opening degree of the bypass expansion valve 62 is adjusted such that a superheating degree SHb of the refrigerant at the outlet on the bypass refrigerant circuit side of the subcooler 25 becomes a target superheating degree SHbs. In the present embodiment, the superheating degree SHb of the refrigerant at the outlet on the bypass refrigerant circuit side of the subcooler 25 is detected by converting the suction pressure Ps of the compressor 21 detected by the suction pressure sensor 29 to saturated temperature corresponding to the evaporation temperature Te, and subtracting this saturated temperature of the refrigerant from the refrigerant temperature detected by the bypass temperature sensor 63. Note that, although it is not employed in the present embodiment, a temperature sensor may be disposed at an inlet on the bypass refrigerant circuit side of the subcooler 25 such that the superheating degree SHb of the refrigerant at the outlet on the bypass refrigerant circuit side of the subcooler 25 is detected by subtracting the refrigerant temperature detected by this temperature sensor from the refrigerant temperature detected by the bypass temperature sensor 63.

When the compressor 21, the outdoor fan 28, the indoor fans 43 and 53 are started in this state of the refrigerant circuit 10, low-pressure gas refrigerant is sucked into the compressor 21 and compressed into high-pressure gas refrigerant. Subsequently, the high-pressure gas refrigerant is sent to the outdoor heat exchanger 23 via the four-way switching valve 22, exchanges heat with the outdoor air supplied by the outdoor fan 28, and becomes condensed into high-pressure liquid refrigerant. Then, this high-pressure liquid refrigerant passes through the outdoor expansion valve 38, flows into the subcooler 25, exchanges heat with the refrigerant flowing in the bypass refrigerant circuit 61, is further cooled, and becomes subcooled. At this time, a portion of the high-pressure liquid refrigerant condensed in the outdoor heat exchanger 23 is branched into the bypass refrigerant circuit 61 and is depressurized by the bypass expansion valve 62. Subsequently, it is returned to the suction side of the compressor 21. Here, the refrigerant that passes through the bypass expansion valve 62 is depressurized close to the suction pressure Ps of the compressor 21 and thereby a portion of the refrigerant evaporates. Then, the refrigerant flowing from the outlet of the bypass expansion valve 62 of the bypass refrigerant circuit 61 toward the suction side of the compressor 21 passes through the subcooler 25 and exchanges heat with high-pressure liquid refrigerant sent from the outdoor heat exchanger 23 on the main refrigerant circuit side to the indoor units 4 and 5.

Then, the high-pressure liquid refrigerant that has become subcooled is sent to the indoor units 4 and 5 via the liquid side stop valve 26 and the liquid refrigerant communication pipe 6. The high-pressure liquid refrigerant sent to the indoor units 4 and 5 is depressurized close to the suction pressure Ps of the compressor 21 by the indoor expansion valves 41 and 51, becomes refrigerant in a low-pressure gas-liquid two-phase state, is sent to the indoor heat exchangers 42 and 52, exchanges heat with the room air in the indoor heat exchangers 42 and 52, and is evaporated into low-pressure gas refrigerant.

This low-pressure gas refrigerant is sent to the outdoor unit 2 via the gas refrigerant communication pipe 7, and flows into the accumulator 24 via the gas side stop valve 27 and the four-way switching valve 22. Then, the low-pressure gas refrigerant that flowed into the accumulator 24 passes by the downstream charge port P, and the temperature of the refrigerant is detected by the downstream temperature sensor 92. Thereafter, the refrigerant is again sucked into the compressor 21.

(Heating Operation)

Next, the heating operation in the normal operation mode is described.

During the heating operation, the four-way switching valve 22 is in a state represented by the dotted lines in FIG. 1, i.e., a state where the discharge side of the compressor 21 is connected to the gas sides of the indoor heat exchangers 42 and 52 via the gas side stop valve 27 and the gas refrigerant communication pipe 7 and also the suction side of the compressor 21 is connected to the gas side of the outdoor heat exchanger 23. The opening degree of the outdoor expansion valve 38 is adjusted so as to be able to depressurize the refrigerant that flows into the outdoor heat exchanger 23 to a pressure where the refrigerant can evaporate (i.e., evaporation pressure Pe) in the outdoor heat exchanger 23. In addition, the liquid side stop valve 26 and the gas side stop valve 27 are in an opened state. The opening degree of the indoor expansion valves 41 and 51 is adjusted such that a subcooling degree SCr of the refrigerant at the outlets of the indoor heat exchangers 42 and 52 becomes constant at the target subcooling degree SCrs. In the present embodiment, a subcooling degree SCr of the refrigerant at the outlets of the indoor heat exchangers 42 and 52 is detected by converting the discharge pressure Pd of the compressor 21 detected by the discharge pressure sensor 30 to saturated temperature corresponding to the condensation temperature Tc, and subtracting the refrigerant temperature detected by the liquid side temperature sensors 44 and 54 from this saturated temperature of the refrigerant. Note that, although it is not employed in the present embodiment, a temperature sensor that detects the temperature of the refrigerant flowing through each of the indoor heat exchangers 42 and 52 may be disposed such that the subcooling degree SCr of the refrigerant at the outlets of the indoor heat exchangers 42 and 52 is detected by subtracting the refrigerant temperature corresponding to the condensation temperature Tc which is detected by this temperature sensor from the refrigerant temperature detected by the liquid side temperature sensors 44 and 54. In addition, the bypass expansion valve 62 is closed.

When the compressor 21, the outdoor fan 28, the indoor fans 43 and 53 are started in this state of the refrigerant circuit 10, low-pressure gas refrigerant is sucked into the compressor 21, compressed into high-pressure gas refrigerant, and sent to the indoor units 4 and 5 via the four-way switching valve 22, the gas side stop valve 27, and the gas refrigerant communication pipe 7.

Then, the high-pressure gas refrigerant sent to the indoor units 4 and 5 exchanges heat with the room air in the indoor heat exchangers 42 and 52 and is condensed into high-pressure liquid refrigerant. Subsequently, it is depressurized according to the opening degree of the indoor expansion valves 41 and 51 when passing through the indoor expansion valves 41 and 51.

The refrigerant that passed through the indoor expansion valves 41 and 51 is sent to the outdoor unit 2 via the liquid refrigerant communication pipe 6, is further depressurized via the liquid side stop valve 26, the subcooler 25, and the outdoor expansion valve 38, and then flows into the outdoor heat exchanger 23. Then, the refrigerant in a low-pressure gas-liquid two-phase state that flowed into the outdoor heat exchanger 23 exchanges heat with the outdoor air supplied by the outdoor fan 28, is evaporated into low-pressure gas refrigerant, and flows into the accumulator 24 via the four-way switching valve 22. Then, the low-pressure gas refrigerant that flowed into the accumulator 24 passes by the downstream charge port P, and the temperature of the refrigerant is detected by the downstream temperature sensor 92. Thereafter, the refrigerant is again sucked into the compressor 21.

Such operation control as described above in the normal operation mode is performed by the controller 8 (more specifically, the indoor side controllers 47 and 57, the outdoor side controller 37, and the transmission line 8*a* that connects between the controllers 37, 47 and 57) that functions as normal operation controlling means to perform the normal operation that includes the cooling operation and the heating operation.

<Test Operation Mode>

Figure 3:
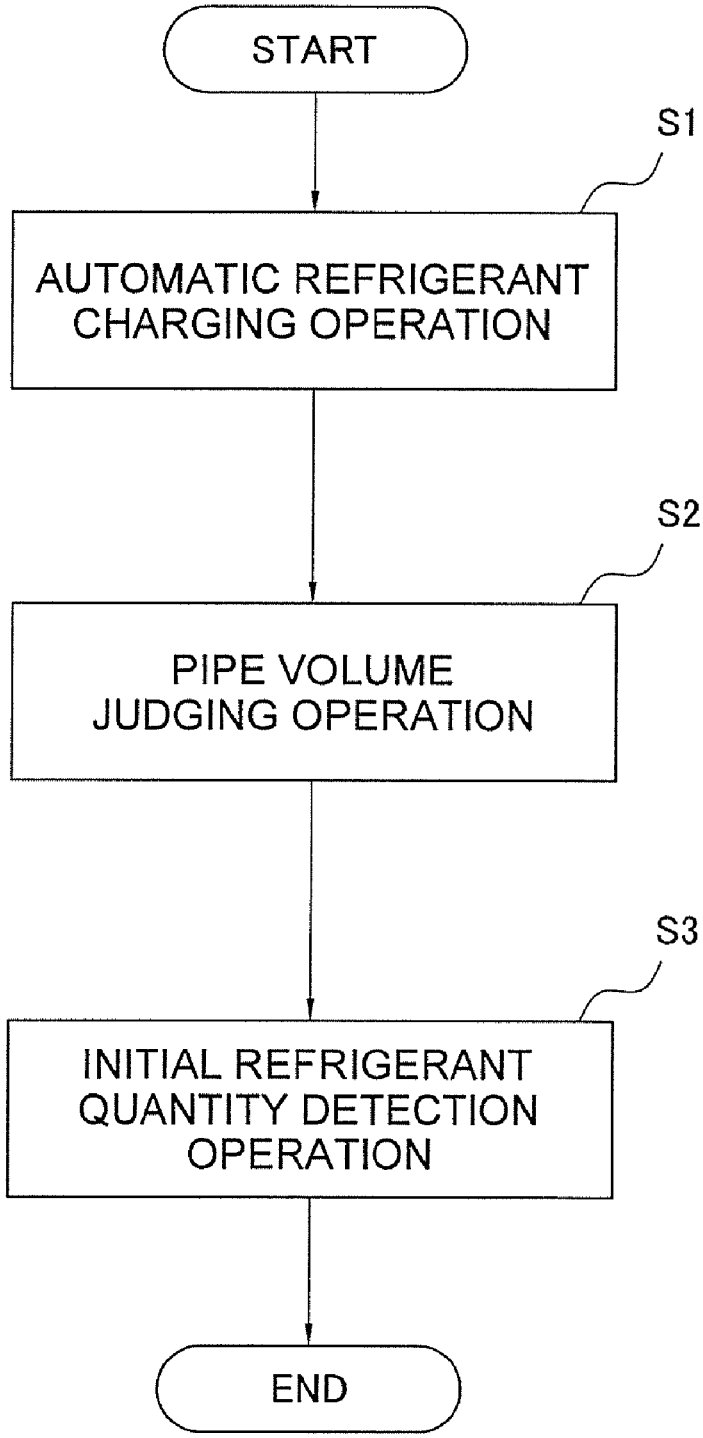
FIG. 3 is a flowchart of a test operation mode.

Next, the test operation mode is described with reference to FIGS. 1 to 3. Here, FIG. 3 is a flowchart of the test operation mode. In the present embodiment, in the test operation mode, first, the automatic refrigerant charging operation in Step S1 is performed. Subsequently, the pipe volume judging operation in Step S2 is performed, and then the initial refrigerant quantity detection operation in Step S3 is performed.

In the present embodiment, an example of a case is described where, the outdoor unit 2 in which the refrigerant is charged in advance and the indoor units 4 and 5 are installed at an installation location such as a building, and the outdoor unit 2, the indoor units 4, 5 are interconnected via the liquid refrigerant communication pipe 6 and the gas refrigerant communication pipe 7 to configure the refrigerant circuit 10, and subsequently additional refrigerant is charged into the refrigerant circuit 10 whose refrigerant quantity is insufficient according to the volumes of the liquid refrigerant communication pipe 6 and the gas refrigerant communication pipe 7.

(Step S1: Automatic Refrigerant Charging Operation)

First, the liquid side stop valve 26 and the gas side stop valve 27 of the outdoor unit 2 are opened and the refrigerant circuit 10 is filled with the refrigerant that is charged in the outdoor unit 2 in advance.

Figure 4:
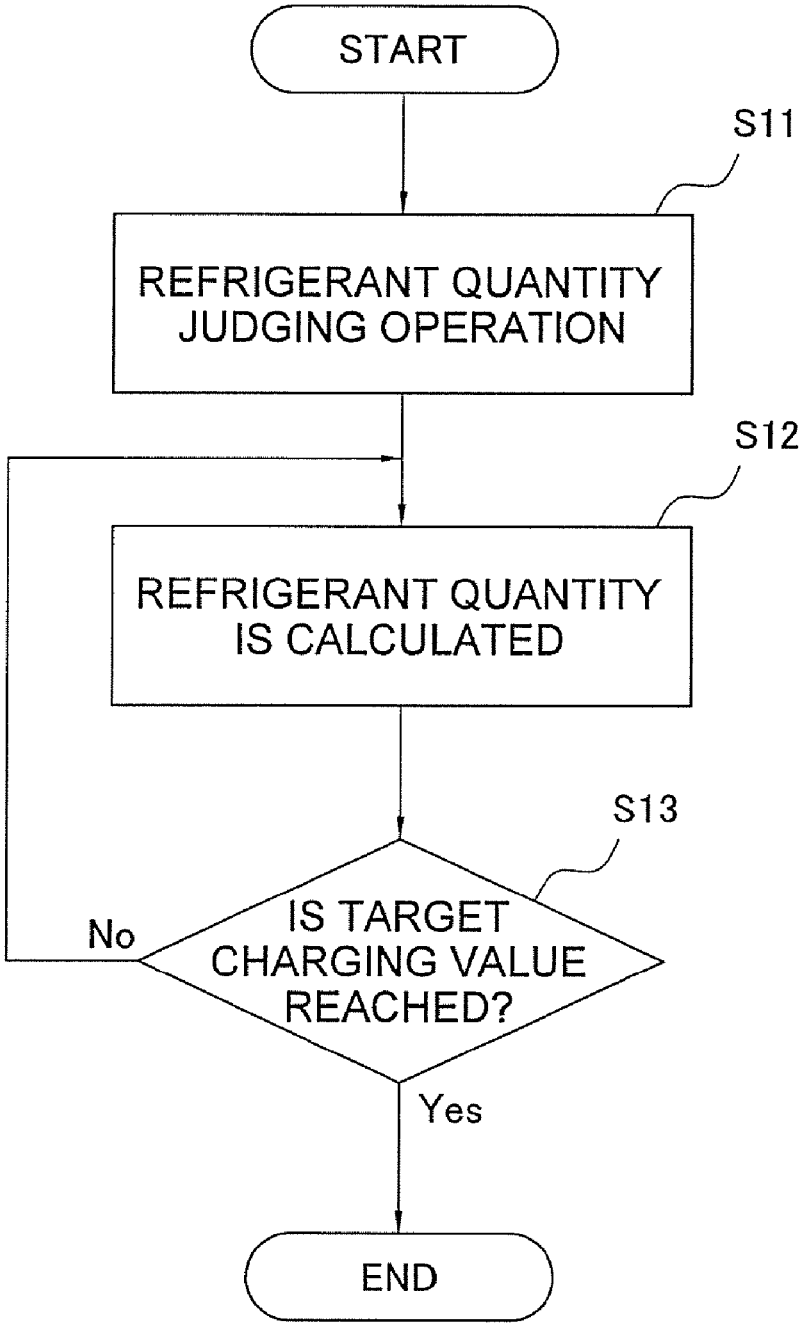
FIG. 4 is a flowchart of an automatic refrigerant charging operation.

Next, when the operator performing the test operation connects the refrigerant cylinder 90 for additional charging to the charge port P of the refrigerant circuit 10 (see FIG. 14) and issues a command to start the test operation directly to the controller 8 or remotely by a remote controller (not shown) and the like, the controller 8 starts the process from Step S11 to Step S13 shown in FIG. 4. Here, FIG. 4 is a flowchart of the automatic refrigerant charging operation.

(Step S11: Refrigerant Quantity Judging Operation)

When a command to start the automatic refrigerant charging operation is issued, the refrigerant circuit 10, with the four-way switching valve 22 of the outdoor unit 2 in the state represented by the solid lines in FIG. 1, becomes a state where the indoor expansion valves 41 and 51 of the indoor units 4 and 5 and the outdoor expansion valve 38 are opened. Then, the compressor 21, the outdoor fan 28, and the indoor fans 43 and 53 are started, and the cooling operation is forcibly performed in all of the indoor units 4 and 5 (hereinafter referred to as "all indoor unit operation").

Figure 5:
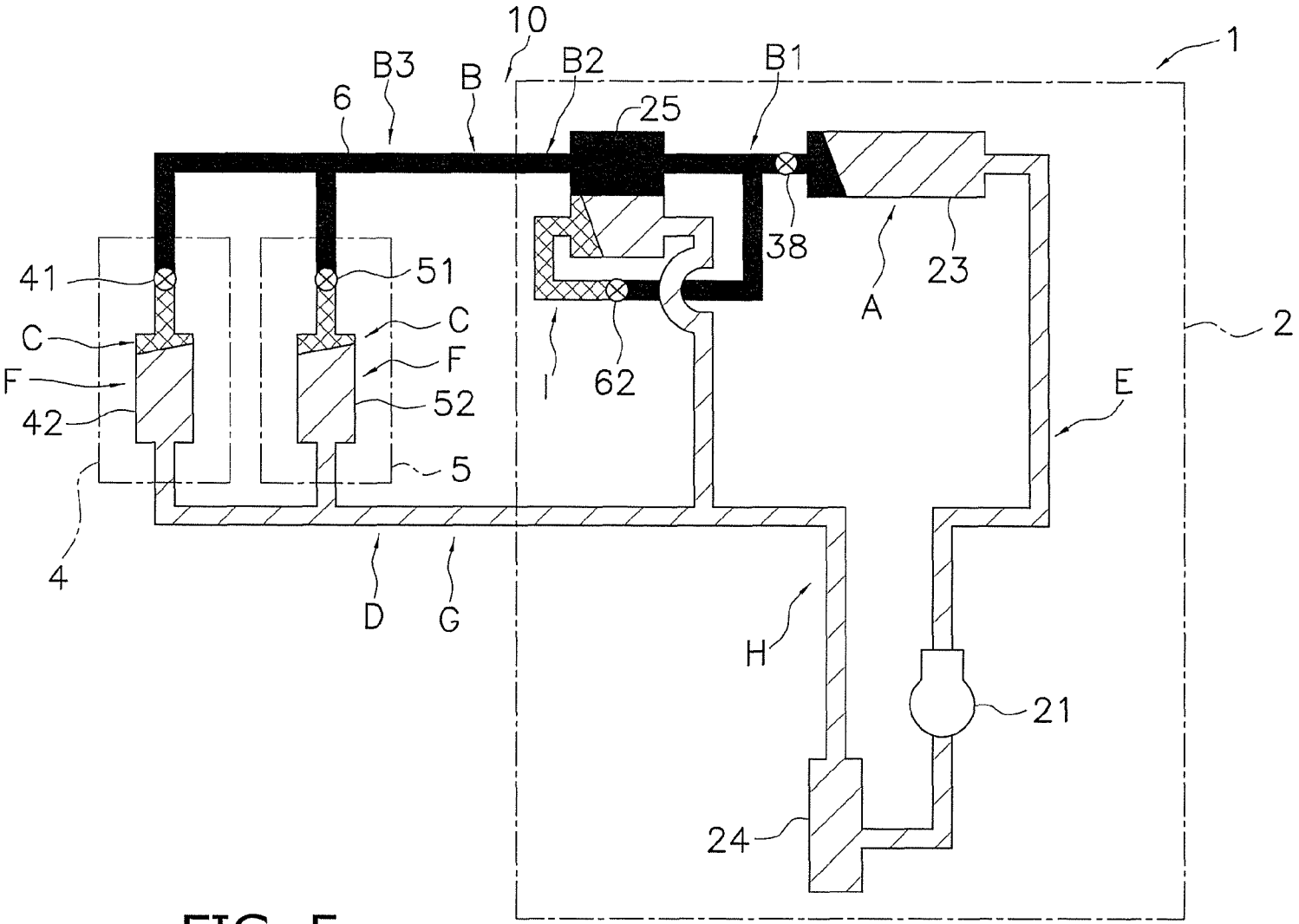
FIG. 5 is a schematic diagram to show a state of refrigerant flowing in a refrigerant circuit in a refrigerant quantity judging operation (illustrations of a four-way switching valve and the like are omitted).

Consequently, as shown in FIG. 5, in the refrigerant circuit 10, the high-pressure gas refrigerant compressed and discharged in the compressor 21 flows along a flow path from the compressor 21 to the outdoor heat exchanger 23 that functions as a condenser (see the portion from the compressor 21 to the outdoor heat exchanger 23 in the hatching area indicated by the diagonal line in FIG. 5); the high-pressure refrigerant that undergoes phase-change from a gas state to a liquid state by heat exchange with the outdoor air flows in the outdoor heat exchanger 23 that functions as a condenser (see the portion corresponding to the outdoor heat exchanger 23 in the hatching area indicated by the diagonal line and the black-lacquered hatching area in FIG. 5); the high-pressure liquid refrigerant flows along a flow path from the outdoor heat exchanger 23 to the indoor expansion valves 41 and 51 including the outdoor expansion valve 38, the portion corresponding to the main refrigerant circuit side of the subcooler 25 and the liquid refrigerant communication pipe 6, and a flow path from the outdoor heat exchanger 23 to the bypass expansion valve 62 (see the portions from the outdoor heat exchanger 23 to the indoor expansion valves 41 and 51 and to the bypass expansion valve 62 in the area indicated by the black hatching in FIG. 5); the low-pressure refrigerant that undergoes phase-change from a gas-liquid two-phase state to a gas state by heat exchange with the room air flows in the portions corresponding to the indoor heat exchangers 42 and 52 that function as evaporators and the portion corresponding to the bypass refrigerant circuit side of the subcooler 25 (see the portions corresponding to the indoor heat exchangers 42 and 52 and the portion corresponding to the subcooler 25 in the area indicated by the lattice hatching and the hatching indicated by the diagonal line in FIG. 5); and the low-pressure gas refrigerant flows along a flow path from the indoor heat exchangers 42 and 52 to the compressor 21 including the gas refrigerant communication pipe 7 and the accumulator 24 and a flow path from the portion corresponding to the bypass refrigerant circuit side of the subcooler 25 to the compressor 21 (see the portion from the indoor heat exchangers 42 and 52 to the compressor 21 and the portion from the portion corresponding to the bypass refrigerant circuit side of the subcooler 25 to the compressor 21 in the hatching area indicated by the diagonal line in FIG. 5). FIG. 5 is a schematic diagram to show a state of the refrigerant flowing in the refrigerant circuit 10 in a refrigerant quantity judging operation (illustrations of the four-way switching valve 22 and the like are omitted).

Next, equipment control as described below is performed to proceed to operation to stabilize the state of the refrigerant circulating in the refrigerant circuit 10. Specifically, the indoor expansion valves 41 and 51 are controlled such that the superheating degree SHr of the indoor heat exchangers 42 and 52 that function as evaporators becomes constant (hereinafter referred to as "superheating degree control"); the operation capacity of the compressor 21 is controlled such that an evaporation pressure Pe becomes constant (hereinafter referred to as "evaporation pressure control"); the air flow rate Wo of outdoor air supplied to the outdoor heat exchanger 23 by the outdoor fan 28 is controlled such that a condensation pressure Pc of the refrigerant in the outdoor heat exchanger 23 becomes constant (hereinafter referred to as "condensation pressure control"); the operation capacity of the subcooler 25 is controlled such that the temperature of the refrigerant sent from the subcooler 25 to the indoor expansion valves 41 and 51 becomes constant (hereinafter referred to as "liquid pipe temperature control"); and the air flow rate Wr of room air supplied to the indoor heat exchangers 42 and 52 by the indoor fans 43 and 53 is maintained constant such that the evaporation pressure Pe of the refrigerant is stably controlled by the above described evaporation pressure control.

Here, the reason to perform the evaporation pressure control is that the evaporation pressure Pe of the refrigerant in the indoor heat exchangers 42 and 52 that function as evaporators is greatly affected by the refrigerant quantity in the indoor heat exchangers 42 and 52 where low-pressure refrigerant flows while undergoing a phase change from a gas-liquid two-phase state to a gas state as a result of heat exchange with the room air (see the portions corresponding to the indoor heat exchangers 42 and 52 in the area indicated by the lattice hatching and hatching indicated by the diagonal line in FIG. 5, which is hereinafter referred to as "evaporator portion C"). Consequently, here, a state is created in which the refrigerant quantity in the evaporator portion C changes mainly by the evaporation pressure Pe by causing the evaporation pressure Pe of the refrigerant in the indoor heat exchangers 42 and 52 to become constant and by stabilizing the state of the refrigerant flowing in the evaporator portion C as a result of controlling the operation capacity of the compressor 21 by the motor 21*a* whose rotation frequency Rm is controlled by an inverter. Note that, the control of the evaporation pressure Pe by the compressor 21 in the present embodiment is achieved in the following manner: the refrigerant temperature (which corresponds to the evaporation temperature Te) detected by the liquid side temperature sensors 44 and 54 of the indoor heat exchangers 42 and 52 is converted to saturation pressure; the operation capacity of the compressor 21 is controlled such that the saturation pressure becomes constant at a target low pressure Pes (in other words, the control to change the rotation frequency Rm of the motor 21*a* is performed); and then a refrigerant circulation flow rate Wc flowing in the refrigerant circuit 10 is increased or decreased. Note that, although it is not employed in the present embodiment, the operation capacity of the compressor 21 may be controlled such that the suction pressure Ps of the compressor 21 detected by the suction pressure sensor 29, which is the operation state quantity equivalent to the pressure of the refrigerant at the evaporation pressure Pe of the refrigerant in the indoor heat exchangers 42 and 52, becomes constant at the target low pressure Pes, or the saturation temperature (which corresponds to the evaporation temperature Te) corresponding to the suction pressure Ps becomes constant at a target low pressure Tes. Also, the operation capacity of the compressor 21 may be controlled such that the refrigerant temperature (which corresponds to the evaporation temperature Te) detected by the liquid side temperature sensors 44 and 54 of the indoor heat exchangers 42 and 52 becomes constant at the target low pressure Tes.

Then, by performing such evaporation pressure control, the state of the refrigerant flowing in the refrigerant pipes from the indoor heat exchangers 42 and 52 to the compressor 21 including the gas refrigerant communication pipe 7 and the accumulator 24 (see the portion from the indoor heat exchangers 42 and 52 to the compressor 21 in the hatching area indicated by the diagonal line in FIG. 5, which is hereinafter referred to as "gas refrigerant distribution portion D") becomes stabilized, creating a state where the refrigerant quantity in the gas refrigerant distribution portion D changes mainly by the evaporation pressure Pe (i.e., the suction pressure Ps), which is the operation state quantity equivalent to the pressure of the refrigerant in the gas refrigerant distribution portion D.

In addition, the reason to perform the condensation pressure control is that the condensation pressure Pc of the refrigerant is greatly affected by the refrigerant quantity in the outdoor heat exchanger 23 where high-pressure refrigerant flows while undergoing a phase change from a gas state to a liquid state as a result of heat exchange with the outdoor air (see the portions corresponding to the outdoor heat exchanger 23 in the area indicated by the diagonal line hatching and the black hatching in FIG. 5, which is hereinafter referred to as "condenser portion A"). The condensation pressure Pc of the refrigerant in the condenser portion A greatly changes due to the effect of the outdoor temperature Ta. Therefore, the air flow rate Wo of the room air supplied from the outdoor fan 28 to the outdoor heat exchanger 23 is controlled by the motor 28*a*, and thereby the condensation pressure Pc of the refrigerant in the outdoor heat exchanger 23 is maintained constant and the state of the refrigerant flowing in the condenser portion A is stabilized, creating a state where the refrigerant quantity in condenser portion A changes mainly by a subcooling degree SCo at the liquid side of the outdoor heat exchanger 23 (hereinafter regarded as the outlet of the outdoor heat exchanger 23 in the description regarding the refrigerant quantity judging operation). Note that, for the control of the condensation pressure Pc by the outdoor fan 28 in the present embodiment, the discharge pressure Pd of the compressor 21 detected by the discharge pressure sensor 30, which is the operation state quantity equivalent to the condensation pressure Pc of the refrigerant in the outdoor heat exchanger 23, or the temperature of the refrigerant flowing through the outdoor heat exchanger 23 (i.e., the condensation temperature Tc) detected by the heat exchanger temperature sensor 33 is used.

Then, by performing such condensation pressure control, the high-pressure liquid refrigerant flows along a flow path from the outdoor heat exchanger 23 to the indoor expansion valves 41 and 51 including the outdoor expansion valve 38, the portion on the main refrigerant circuit side of the subcooler 25, and a flow path including the liquid refrigerant communication pipe 6 and a flow path from the outdoor heat exchanger 23 to the bypass expansion valve 62 of the bypass refrigerant circuit 61; the pressure of the refrigerant in the portions from the outdoor heat exchanger 23 to the indoor expansion valves 41 and 51 and to the bypass expansion valve 62 (see the area indicated by the black hatching in FIG. 5, which is hereinafter referred to as "liquid refrigerant distribution portion B") also becomes stabilized; and the liquid refrigerant distribution portion B is sealed by the liquid refrigerant, thereby becoming a stable state.

In addition, the reason to perform the liquid pipe temperature control is to prevent a change in the density of the refrigerant in the refrigerant pipes from the subcooler 25 to the indoor expansion valves 41 and 51 including the liquid refrigerant communication pipe 6 (see the portion from the subcooler 25 to the indoor expansion valves 41 and 51 in the liquid refrigerant distribution portion B shown in FIG. 5). Performance of the subcooler 25 is controlled by increasing or decreasing the flow rate of the refrigerant flowing in the bypass refrigerant circuit 61 such that the refrigerant temperature Tlp detected by the liquid pipe temperature sensor 35 disposed at the outlet on the main refrigerant circuit side of the subcooler 25 becomes constant at a target liquid pipe temperature Tlps, and by adjusting the quantity of heat exchange between the refrigerant flowing through the main refrigerant circuit side and the refrigerant flowing through the bypass refrigerant circuit side of the subcooler 25. Note that, the flow rate of the refrigerant flowing in the bypass refrigerant circuit 61 is increased or decreased by adjustment of the opening degree of the bypass expansion valve 62. In this way, the liquid pipe temperature control is achieved in which the refrigerant temperature in the refrigerant pipes from the subcooler 25 to the indoor expansion valves 41 and 51 including the liquid refrigerant communication pipe 6 becomes constant.

Then, by performing such liquid pipe temperature constant control, even when the refrigerant temperature Tco at the outlet of the outdoor heat exchanger 23 (i.e., the subcooling degree SCo of the refrigerant at the outlet of the outdoor heat exchanger 23) changes along with a gradual increase in the refrigerant quantity in the refrigerant circuit 10 by charging refrigerant into the refrigerant circuit 10, the effect of a change in the refrigerant temperature Tco at the outlet of the outdoor heat exchanger 23 will remain only within the refrigerant pipes from the outlet of the outdoor heat exchanger 23 to the subcooler 25, and the effect will not extend to the refrigerant pipes from the subcooler 25 to the indoor expansion valves 41 and 51 including the liquid refrigerant communication pipe 6 in the liquid refrigerant distribution portion B.

Further, the reason to perform the superheating degree control is because the refrigerant quantity in the evaporator portion C greatly affects the quality of wet vapor of the refrigerant at the outlets of the indoor heat exchangers 42 and 52. The superheating degree SHr of the refrigerant at the outlets of the indoor heat exchangers 42 and 52 is controlled such that the superheating degree SHr of the refrigerant at the gas sides of the indoor heat exchangers 42 and 52 (hereinafter regarded as the outlets of the indoor heat exchangers 42 and 52 in the description regarding the refrigerant quantity judging operation) becomes constant at the target superheating degree SHrs (in other words, the gas refrigerant at the outlets of the indoor heat exchangers 42 and 52 is in a superheated state) by controlling the opening degree of the indoor expansion valves 41 and 51, and thereby the state of the refrigerant flowing in the evaporator portion C is stabilized.

Consequently, by performing such superheating degree control, a state is created in which the gas refrigerant reliably flows into the gas refrigerant communication portion D.

By various control described above, the state of the refrigerant circulating in the refrigerant circuit 10 becomes stabilized, and the distribution of the refrigerant quantity in the refrigerant circuit 10 becomes constant. Therefore, when refrigerant starts to be charged into the refrigerant circuit 10 by additional refrigerant charging from the refrigerant cylinder 90, which is subsequently performed, it is possible to create a state where a change in the refrigerant quantity in the refrigerant circuit 10 mainly appears as a change of the refrigerant quantity in the outdoor heat exchanger 23 (hereinafter this operation is referred to as "refrigerant quantity judging operation").

Such control as described above is performed as the process in Step S11 by the controller 8 (more specifically, by the indoor side controllers 47 and 57, the outdoor side controller 37, and the transmission line 8*a* that connects between the controllers 37, 47 and 57) that functions as refrigerant quantity judging operation controlling means for performing the refrigerant quantity judging operation.

Note that, unlike the present embodiment, when refrigerant is not charged in advance in the outdoor unit 2, it is necessary prior to Step S11 to charge refrigerant until the refrigerant quantity reaches a level where constituent equipment will not abnormally stop during the above described refrigerant quantity judging operation.

(Step S12: Refrigerant Quantity Calculation)

Next, additional refrigerant is charged into the refrigerant circuit 10 while performing the above described refrigerant quantity judging operation.

In order to do so, as shown in FIGS. 1 and 11, the refrigerant cylinder 90 is connected to the charge port P. At this time, the controller 8 that functions as refrigerant quantity calculating means calculates the refrigerant quantity in the refrigerant circuit 10 from the operation state quantity of constituent equipment or refrigerant flowing in the refrigerant circuit 10 during additional refrigerant charging in Step S12.

First, the refrigerant quantity calculating means in the present embodiment is described. The refrigerant quantity calculating means divides the refrigerant circuit 10 into a plurality of portions, calculates the refrigerant quantity for each divided portion, and thereby calculates the refrigerant quantity in the refrigerant circuit 10.

More specifically, a relational expression between the refrigerant quantity in each portion and the operation state quantity of constituent equipment or refrigerant flowing in the refrigerant circuit 10 is set for each divided portion, and the refrigerant quantity in each portion can be calculated by using these relational expressions. In the present embodiment, in a state where the four-way switching valve 22 is represented by the solid lines in FIG. 1, i.e., a state where the discharge side of the compressor 21 is connected to the gas side of the outdoor heat exchanger 23 and where the suction side of the compressor 21 is connected to the outlets of the indoor heat exchangers 42 and 52 via the gas side stop valve 27 and the gas refrigerant communication pipe 7, the refrigerant circuit 10 is divided into each of the following portions A to I.

The refrigerant circuit 10 is divided into the following portions and a relational expression is set for each portion: a portion corresponding to the compressor 21 and a portion from the compressor 21 to the outdoor heat exchanger 23 including the four-way switching valve 22 (not shown in FIG. 5) (hereinafter referred to as "high-pressure gas pipe portion E"); secondly, a portion corresponding to the outdoor heat exchanger 23 (i.e., the condenser portion A); a portion from the outdoor heat exchanger 23 to the subcooler 25 and an inlet side half of the portion corresponding to the main refrigerant circuit side of the subcooler 25 in the liquid refrigerant distribution portion B (hereinafter referred to as "high temperature side liquid pipe portion B1"); an outlet side half of a portion corresponding to the main refrigerant circuit side of the subcooler 25 and a portion from the subcooler 25 to the liquid side stop valve 26 (not shown in FIG. 5) in the liquid refrigerant distribution portion B (hereinafter referred to as "low temperature side liquid pipe portion B2"); a portion corresponding to the liquid refrigerant communication pipe 6 in the liquid refrigerant distribution portion B (hereinafter referred to as "liquid refrigerant communication pipe portion B3"); a portion from the liquid refrigerant communication pipe 6 in the liquid refrigerant distribution portion B to the gas refrigerant communication pipe 7 in the gas refrigerant distribution portion D including portions corresponding to the indoor expansion valves 41 and 51 and the indoor heat exchangers 42 and 52 (i.e., the evaporator portion C) (hereinafter referred to as "indoor unit portion F"); a portion corresponding to the gas refrigerant communication pipe 7 in the gas refrigerant distribution portion D (hereinafter referred to as "gas refrigerant communication pipe portion G"); a portion from the gas side stop valve 27 (not shown in FIG. 5) in the gas refrigerant distribution portion D to the compressor 21 including the four-way switching valve 22 and the accumulator 24 (hereinafter referred to as "low-pressure gas pipe portion H"); and a portion from the high temperature side liquid pipe portion B1 in the liquid refrigerant distribution portion B to the low-pressure gas pipe portion H including the bypass expansion valve 62 and a portion corresponding to the bypass refrigerant circuit side of the subcooler 25 (hereinafter referred to as "bypass circuit portion I").

Next, the relational expressions set for each of the portions A to I described above are described.

In the present embodiment, a relational expression between a refrigerant quantity Mog1 in the high-pressure gas pipe portion E and the operation state quantity of constituent equipment or refrigerant flowing in the refrigerant circuit 10 is, for example, expressed by $$Mog1 = Vog1 \times \rho d,$$

which is a function expression in which a volume Vog1 of the high-pressure gas pipe portion E in the outdoor unit 2 is multiplied by the density ρd of the refrigerant in high-pressure gas pipe portion E. Note that, the volume Vog1 of the high-pressure gas pipe portion E is a value that is known prior to installation of the outdoor unit 2 at the installation location and is stored in advance in the memory of the controller 8. In addition, a density ρd of the refrigerant in the high-pressure gas pipe portion E is obtained by converting the discharge temperature Td and the discharge pressure Pd.

A relational expression between a refrigerant quantity Mc in the condenser portion A and the operation state quantity of constituent equipment or refrigerant flowing in the refrigerant circuit 10 is, for example, expressed by $$Mc = kc1 \times Ta + kc2 \times Tc + kc3 \times SHm + kc4 \times Wc + kc5 \times \rho c + kc6 \times \rho co + kc7,$$

which is a function expression of the outdoor temperature Ta, the condensation temperature Tc, a compressor discharge superheating degree SHm, the refrigerant circulation flow rate Wc, the saturated liquid density ρc of the refrigerant in the outdoor heat exchanger 23, and the density ρco of the refrigerant at the outlet of the outdoor heat exchanger 23. Note that, the parameters kc1 to kc7 in the above described relational expression are derived from a regression analysis of results of tests and detailed simulations and are stored in advance in the memory of the controller 8. In addition, the compressor discharge superheating degree SHm is a superheating degree of the refrigerant at the discharge side of the compressor, and is obtained by converting the discharge pressure Pd to refrigerant saturation temperature and subtracting this refrigerant saturation temperature from the discharge temperature Td. The refrigerant circulation flow rate Wc is expressed as a function of the evaporation temperature Te and the condensation temperature Tc (i.e., We=f(Te, Tc)). A saturated liquid density ρc of the refrigerant is obtained by converting the condensation temperature Tc. A density ρco of the refrigerant at the outlet of the outdoor heat exchanger 23 is obtained by converting the condensation pressure Pc obtained by converting the condensation temperature Tc and the refrigerant temperature Tco.

A relational expression between a refrigerant quantity Mol1 in the high temperature liquid pipe portion B1 and the operation state quantity of constituent equipment or refrigerant flowing in the refrigerant circuit 10 is, for example, expressed by $$Mol1 = Vol1 \times \rho co,$$

which is a function expression in which a volume Vol1 of the high temperature liquid pipe portion B1 in the outdoor unit 2 is multiplied by the density ρco of the refrigerant in the high temperature liquid pipe portion B1 (i.e., the above described density of the refrigerant at the outlet of the outdoor heat exchanger 23). Note that, the volume Vol1 of the high-pressure liquid pipe portion B1 is a value that is known prior to installation of the outdoor unit 2 at the installation location and is stored in advance in the memory of the controller 8.

A relational expression between a refrigerant quantity Mol2 in the low temperature liquid pipe portion B2 and the operation state quantity of constituent equipment or refrigerant flowing in the refrigerant circuit 10 is, for example, expressed by $$Mol2 = Vol2 \times \rho lp,$$

which is a function expression in which a volume Vo12 of the low temperature liquid pipe portion B2 in the outdoor unit 2 is multiplied by a density ρlp of the refrigerant in the low temperature liquid pipe portion B2. Note that, the volume Vol2 of the low temperature liquid pipe portion B2 is a value that is known prior to installation of the outdoor unit 2 at the installation location and is stored in advance in the memory of the controller 8. In addition, the density ρlp of the refrigerant in the low temperature liquid pipe portion B2 is the density of the refrigerant at the outlet of the subcooler 25, and is obtained by converting the condensation pressure Pc and the refrigerant temperature Tlp at the outlet of the subcooler 25.

A relational expression between a refrigerant quantity Mlp in the liquid refrigerant communication pipe portion B3 and the operation state quantity of constituent equipment or refrigerant flowing in the refrigerant circuit 10 is, for example, expressed by $$Mlp = Vlp \times \rho lp,$$

which is a function expression in which a volume Vlp of the liquid refrigerant communication pipe 6 is multiplied by the density ρlp of the refrigerant in the liquid refrigerant communication pipe portion B3 (i.e., the density of the refrigerant at the outlet of the subcooler 25). Note that, as for the volume Vlp of the liquid refrigerant communication pipe 6, because the liquid refrigerant communication pipe 6 is a refrigerant pipe arranged on site when installing the air conditioner 1 at an installation location such as a building, a value calculated on site from the information regarding the length, pipe diameter and the like is input, or information regarding the length, pipe diameter and the like is input on site and the controller 8 calculates the volume Vlp from the input information of the liquid refrigerant communication pipe 6. Or, as described below, the volume Vlp is calculated by using the operation results of the pipe volume judging operation.

A relational expression between a refrigerant quantity Mr in the indoor unit portion F and the operation state quantity of constituent equipment or refrigerant flowing in the refrigerant circuit 10 is, for example, expressed by $$Mr=kr1\times Tlp+kr2\times\Delta T+kr3\times SHr+kr4\times Wr+kr5,$$

which is a function expression of the refrigerant temperature Tlp at the outlet of the subcooler 25, a temperature difference ΔT in which the evaporation temperature Te is subtracted from the room temperature Tr, the superheating degree SHr of the refrigerant at the outlets of the indoor heat exchangers 42 and 52, and the air flow rate Wr of the indoor fans 43 and 53. Note that, the parameters kr1 to kr5 in the above described relational expression are derived from a regression analysis of results of tests and detailed simulations and are stored in advance in the memory of the controller 8. Note that, here, the relational expression for the refrigerant quantity Mr is set for each of the two indoor units 4 and 5, and the entire refrigerant quantity in the indoor unit portion F is calculated by adding the refrigerant quantity Mr in the indoor unit 4 and the refrigerant quantity Mr in the indoor unit 5. Note that, relational expressions having parameters kr1 to kr5 with different values will be used when the model and/or capacity is different between the indoor unit 4 and the indoor unit 5.

A relational expression between a refrigerant quantity Mgp in the gas refrigerant communication pipe portion G and the operation state quantity of constituent equipment or refrigerant flowing in the refrigerant circuit 10 is, for example, expressed by $$Mgp=Vgp\times\rho gp,$$

which is a function expression in which a volume Vgp of the gas refrigerant communication pipe 7 is multiplied by a density ρgp of the refrigerant in the gas refrigerant communication pipe portion H. Note that, as for the volume Vgp of the gas refrigerant communication pipe 7, as is the case with the liquid refrigerant communication pipe 6, because the gas refrigerant communication pipe 7 is a refrigerant pipe arranged on site when installing the air conditioner 1 at an installation location such as a building, a value calculated on site from the information regarding the length, pipe diameter and the like is input, or information regarding the length, pipe diameter and the like is input on site and the controller 8 calculates the volume Vgp from the input information of the gas refrigerant communication pipe 7. Or, as described below, the volume Vgp is calculated by using the operation results of the pipe volume judging operation. In addition, the density ρgp of the refrigerant in the gas refrigerant communication pipe portion G is an average value between a density ρs of the refrigerant at the suction side of the compressor 21 and a density ρeo of the refrigerant at the outlets of the indoor heat exchangers 42 and 52 (i.e., the inlet of the gas refrigerant communication pipe 7). The density ρs of the refrigerant is obtained by converting the suction pressure Ps and the suction temperature Ts, and a density ρeo of the refrigerant is obtained by converting the evaporation pressure Pe, which is a converted value of the evaporation temperature Te, and an outlet temperature Teo of the indoor heat exchangers 42 and 52.

A relational expression between a refrigerant quantity Mog2 in the low-pressure gas pipe portion H and the operation state quantity of constituent equipment or refrigerant flowing in the refrigerant circuit 10 is, for example, expressed by $$Mog2=Vog2\times\rho s,$$

which is a function expression in which a volume Vog2 of the low-pressure gas pipe portion H in the outdoor unit 2 is multiplied by the density ρs of the refrigerant in the low-pressure gas pipe portion H. Note that, the volume Vog2 of the low-pressure gas pipe portion H is a value that is known prior to shipment to the installation location and is stored in advance in the memory of the controller 8.

A relational expression between a refrigerant quantity Mob in the bypass circuit portion I and the operation state quantity of constituent equipment or refrigerant flowing in the refrigerant circuit 10 is, for example, expressed by $$Mob=kob1\times\rho co+kob2\times\rho s+kob3\times Pe+kob4,$$

which is a function expression of a density ρco of the refrigerant at the outlet of the outdoor heat exchanger 23, and the density ρs and evaporation pressure Pe of the refrigerant at the outlet on the bypass circuit side of the subcooler 25. Note that, the parameters kob1 to kob3 in the above described relational expression are derived from a regression analysis of results of tests and detailed simulations and are stored in advance in the memory of the controller 8. In addition, the refrigerant quantity Mob of the bypass circuit portion I may be calculated using a simpler relational expression because the refrigerant quantity there is smaller compared to the other portions. For example, it is expressed as follows:

$$Mob=Vob\times\rho e\times kob5,$$

which is a function expression in which a volume Vob of the bypass circuit portion I is multiplied by the saturated liquid density ρe at the portion corresponding to the bypass circuit side of the subcooler 25 and a correct coefficient kob 5. Note that, the volume Vob of the bypass circuit portion I is a value that is known prior to installation of the outdoor unit 2 at the installation location and is stored in advance in the memory of the controller 8. In addition, the saturated liquid density ρe at the portion corresponding to the bypass circuit side of the subcooler 25 is obtained by converting the suction pressure Ps or the evaporation temperature Te.

Note that, in the present embodiment, one outdoor unit 2 is provided. However, when a plurality of outdoor units are connected, as for the refrigerant quantity in the outdoor unit such as Mog1, Mc, Mol1, Mol2, Mog2, and Mob, the relational expression for the refrigerant quantity in each portion is set for each of the plurality of outdoor units, and the entire refrigerant quantity in the outdoor units is calculated by adding the refrigerant quantity in each portion of the plurality of the outdoor units. Note that, relational expressions for the refrigerant quantity in each portion having parameters with different values will be used when a plurality of outdoor units with different models and capacities are connected.

As described above, in the present embodiment, by using the relational expressions for each of the portions A to I in the refrigerant circuit 10, the refrigerant quantity in each portion is calculated from the operation state quantity of constituent equipment or refrigerant flowing in the refrigerant circuit 10 in the refrigerant quantity judging operation, and thereby the refrigerant quantity in the refrigerant circuit 10 can be calculated.

Further, this Step S12 is repeated until the condition for judging the adequacy of the refrigerant quantity in the below described Step S13 is satisfied. Therefore, in the period from the start to the completion of additional refrigerant charging, the refrigerant quantity in each portion is calculated from the operation state quantity during refrigerant charging by using the relational expressions for each portion in the refrigerant circuit 10. More specifically, a refrigerant quantity Mo in the outdoor unit 2 and the refrigerant quantity Mr in each of the indoor units 4 and 5 (i.e., the refrigerant quantity in each portion in the refrigerant circuit 10 excluding the refrigerant communication pipes 6 and 7) necessary for judgment on the adequacy of the refrigerant quantity in the below described Step S13 are calculated. Here, the refrigerant quantity Mo in the outdoor unit 2 is calculated by adding Mog1, Mc, Mol1, Mol2, Mog2, and Mob described above, each of which is the refrigerant quantity in each portion in the outdoor unit 2.

In this way, the process in Step S12 is performed by the controller 8 that functions as the refrigerant quantity calculating means for calculating the refrigerant quantity in each portion in the refrigerant circuit 10 from the operation state quantity of constituent equipment or refrigerant flowing in the refrigerant circuit 10 in the automatic refrigerant charging operation.

(Step S13: Judgment on the Adequacy of the Refrigerant Quantity)

As described above, when additional refrigerant charging from the refrigerant cylinder 90 into the refrigerant circuit 10 starts, the refrigerant quantity in the refrigerant circuit 10 gradually increases. Here, when the volumes of the refrigerant communication pipes 6 and 7 are unknown, the refrigerant quantity that should be charged into the refrigerant circuit 10 after additional refrigerant charging cannot be prescribed as the refrigerant quantity in the entire refrigerant circuit 10. However, when the focus is placed only on the outdoor unit 2 and the indoor units 4 and 5 (i.e., the refrigerant circuit 10 excluding the refrigerant communication pipes 6 and 7), it is possible to know in advance the optimal refrigerant quantity in the outdoor unit 2 in the normal operation mode by tests and detailed simulations.

Therefore, additional refrigerant charging from the refrigerant cylinder 90 can be completed by storing a value of the above mentioned refrigerant quantity in advance in the memory of the controller 8 as a target charging value Ms and charging additional refrigerant from the refrigerant cylinder 90 until this target charging value Ms is reached by a value of the refrigerant quantity obtained by adding the refrigerant quantity Mo in the outdoor unit 2 and the refrigerant quantity Mr in the indoor units 4 and 5, which are calculated from the operation state quantity of constituent equipment or refrigerant flowing in the refrigerant circuit 10 in the automatic refrigerant charging operation by using the above described relational expressions.

In other words, Step S13 is a process to judge the adequacy of the refrigerant quantity charged into the refrigerant circuit 10 by additional refrigerant charging by judging whether or not the refrigerant quantity, which is obtained by adding the refrigerant quantity Mo in the outdoor unit 2 and the refrigerant quantity Mr in the indoor units 4 and 5 in the automatic refrigerant charging operation, has reached the target charging value Ms.

Further, in Step S13, when a value of the refrigerant quantity obtained by adding the refrigerant quantity Mo in the outdoor unit 2 and the refrigerant quantity Mr in the indoor units 4 and 5 is smaller than the target charging value Ms and additional refrigerant charging has not been completed, the process in Step S13 is repeated until the target charging value Ms is reached. In addition, when a value of the refrigerant quantity obtained by adding the refrigerant quantity Mo in the outdoor unit 2 and the refrigerant quantity Mr in the indoor units 4 and 5 reaches the target charging value Ms, additional refrigerant charging is completed, and Step S1 as the automatic refrigerant charging operation process is completed.

Note that, in the above described refrigerant quantity judging operation, as the amount of additional refrigerant charged into the refrigerant circuit 10 increases, a tendency of an increase in the subcooling degree SCo at the outlet of the outdoor heat exchanger 23 appears, causing the refrigerant quantity Mc in the outdoor heat exchanger 23 to increase, and the refrigerant quantity in the other portions tends to be maintained substantially constant. Therefore, the target charging value Ms may be set as a value corresponding to only the refrigerant quantity Mo in the outdoor unit 2 but not the outdoor unit 2 and the indoor units 4 and 5, or may be set as a value corresponding to the refrigerant quantity Mc in the outdoor heat exchanger 23, and additional refrigerant may be charged until the target charging value Ms is reached.

In this way, the process in Step S13 is performed by the controller 8 that functions as the refrigerant quantity judging means for judging the adequacy of the refrigerant quantity in the refrigerant circuit 10 in the refrigerant quantity judging operation of the automatic refrigerant charging operation (i.e., for judging whether or not the refrigerant quantity has reached the target charging value Ms).

(Judgment on Detection of Empty State of Refrigerant Cylinder and Replacement of Refrigerant Cylinder During Automatic Refrigerant Charging Operation)

Note that, specifically, the above described charging of refrigerant into the refrigerant circuit 10 up to the target charging value Ms is performed as described below, using the refrigerant cylinder 90 connected to the charge port P of the refrigerant circuit 10.

When the above described refrigerant quantity judging operation starts, the controller 8 judges whether or not the operation state of the refrigerant circuit 10 became stabilized. When the controller 8 judges that the operation state became stabilized, the controller 8 causes the display unit 9 to display a sign that indicates that the refrigerant cylinder 90 is in the connectable state. The display on the display unit 9 informs the operator that the refrigerant cylinder 90 is connectable. Then, the operator connects the refrigerant cylinder 90 to the charge port P of the refrigerant circuit 10, and opens the cylinder on/off valve 95. Consequently, the refrigerant contained in the refrigerant cylinder 90 flows into the refrigerant circuit 10 through the charge port P. During this time, the refrigerant quantity judging operation is continuously being performed, and thereby control is performed to stabilize the distribution of the refrigerant circulating in the refrigerant circuit 10.

In step S12, a change in the state of the refrigerant in each part of the refrigerant circuit 10 caused by refrigerant charging from the refrigerant cylinder 90 is detected, and the current value of the refrigerant quantity in the refrigerant circuit 10 is calculated.

In step S13, the controller 8 sequentially judges whether or not the current value of the refrigerant quantity determined in step S12 has reached the target charging value Ms. In step S13, the controller 8 judges whether or not the current value of the refrigerant quantity has reached the target charging value Ms. When the controller 8 judges that the target charging value Ms has been reached, the controller 8 causes the display unit 9 to display a sign that indicates that the target charging value Ms has been reached and stops the automatic refrigerant charging operation. In this way, because a sign is displayed on the display unit 9, the operator will know that the refrigerant has been charged to the point where the refrigerant quantity in the refrigerant circuit 10 reached the target charging value Ms, and closes the cylinder on/off valve 95 to complete the refrigerant charging operation.

On the other hand, when the controller 8 judges that the current value of the refrigerant quantity in the refrigerant circuit 10 has not reached the target charging value Ms, refrigerant charging from the refrigerant cylinder 90 into the refrigerant circuit 10 is continued. At this time, when the refrigerant quantity contained in the refrigerant cylinder 90 is lower than the necessary amount of refrigerant for additional charging in order to reach the target charging value Ms, the refrigerant cylinder 90 may become empty during the charging operation, and the refrigerant cylinder 90 needs to be replaced with a new refrigerant cylinder 90 in order to continue charging.

Here, by each procedure described below, the controller 8 automatically detects that the refrigerant cylinder 90 is emptied and a time to replace the refrigerant cylinder 90 is indicated by the display on the display unit 9. Accordingly, the operator can know a time to replace the refrigerant cylinder 90 with a new refrigerant cylinder 90 without performing operations such as monitoring a change in the weight of the refrigerant cylinder 90 by placing the refrigerant cylinder 90 on a scale or the like.

Figure 12:
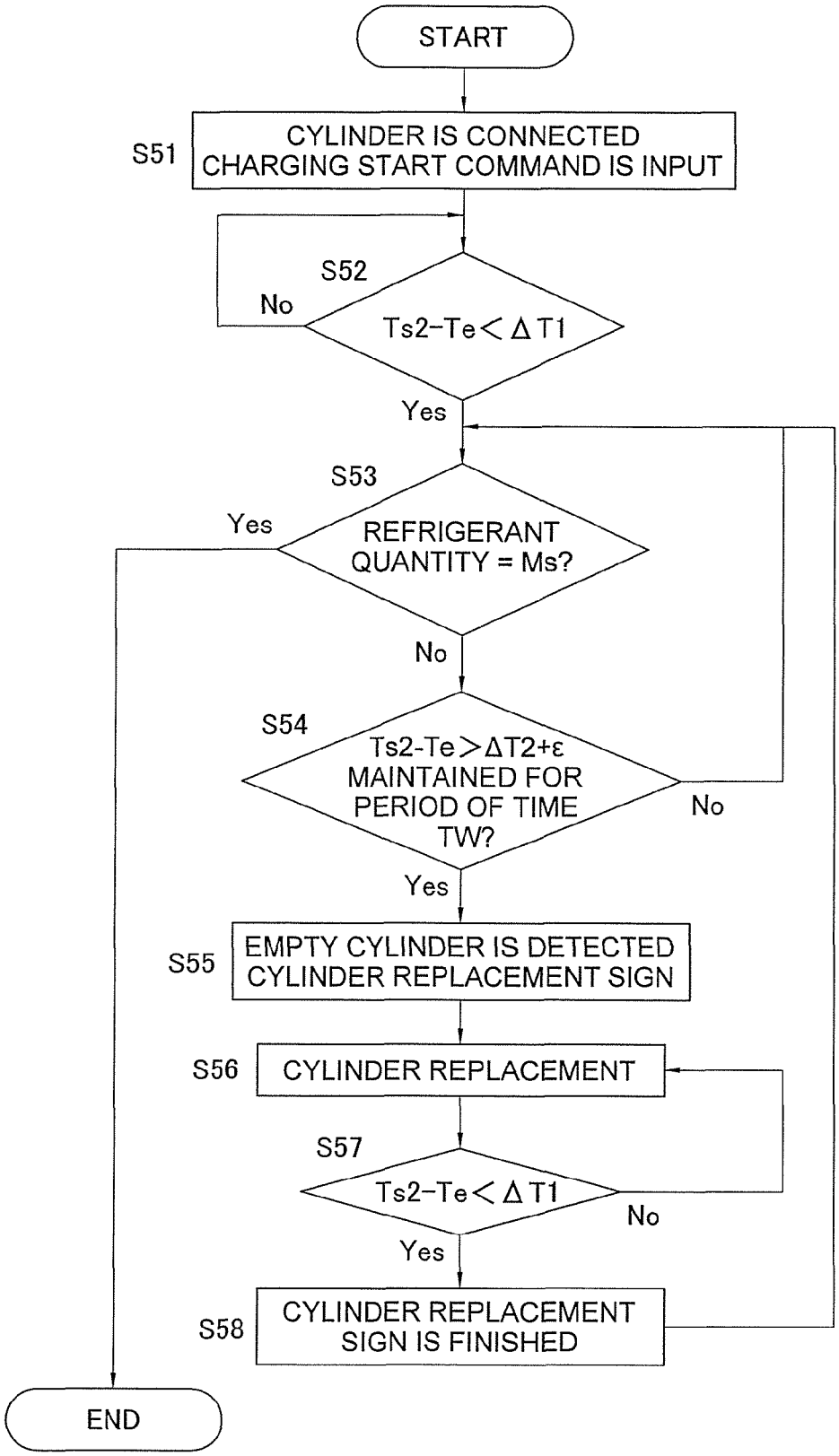
FIG. 12 is a flowchart for charging refrigerant by a plurality of cylinders.

Specifically, a procedure shown in the flowchart in FIG. 12 is carried out.

In step S51, the operator connects the refrigerant cylinder 90 to the refrigerant circuit 10 and opens the cylinder on/off valve 95, which consequently starts refrigerant charging. At this time, as the operator pushes a button (not shown) provided by being connected to the outdoor side controller 37, a command to start the automatic refrigerant charging operation is input into the controller 8, and judgment on detection of the empty state of the refrigerant cylinder starts.

Figure 13:
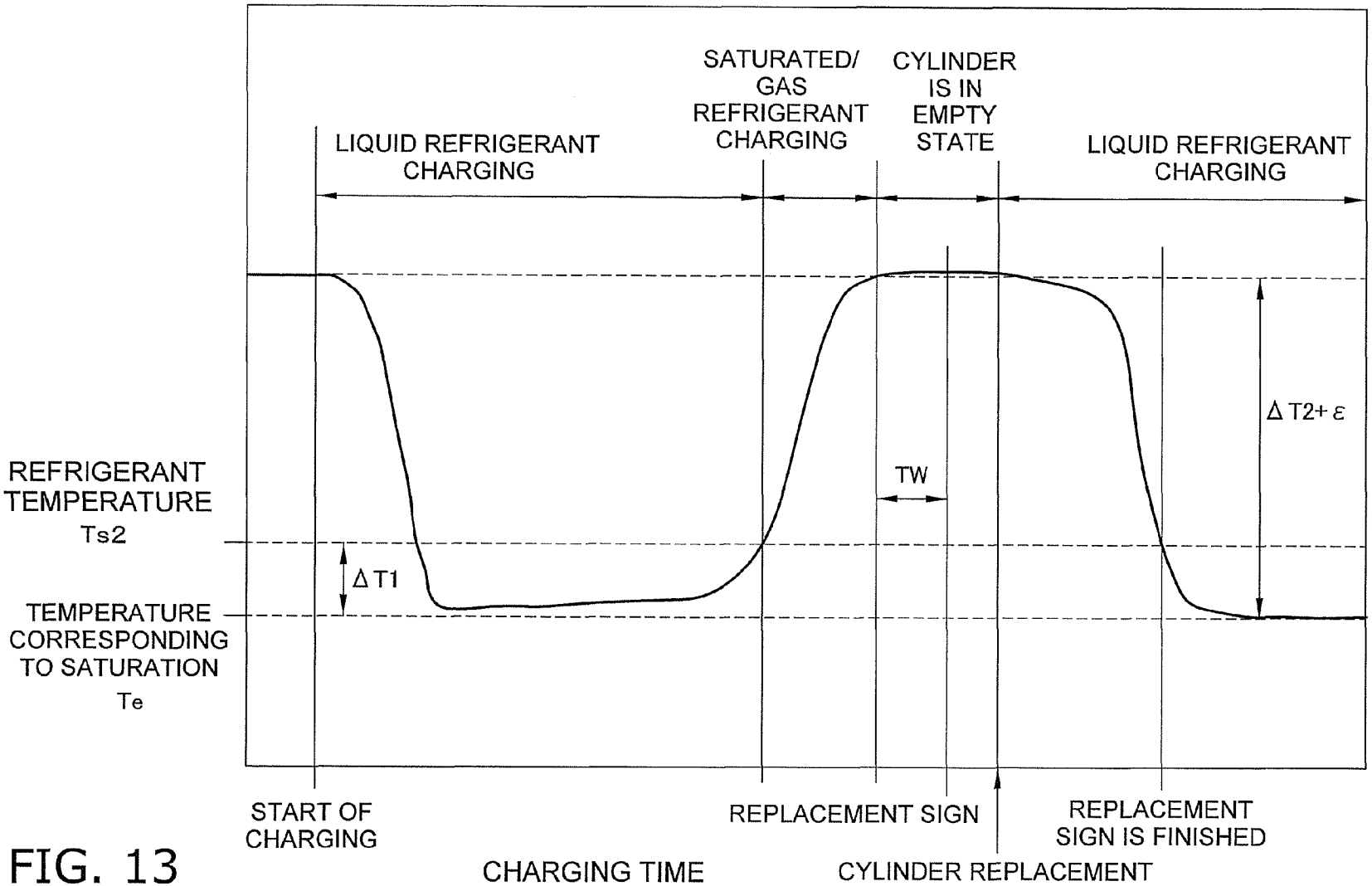
FIG. 13 is a graph to show the detection of the refrigerant temperature by a downstream temperature sensor.

In step S52, the refrigerant from the refrigerant cylinder 90 starts passing through the charge port P, and the superheated gas refrigerant flowing in the refrigerant circuit 10 and the liquid refrigerant charged from the refrigerant cylinder 90 start mixing together. Consequently, as shown in FIG. 13, such change of the refrigerant into a mixed state is detected as a rapid drop in a temperature Ts2 detected by the downstream temperature sensor 92. Here, the controller 8 judges whether or not the difference (superheating degree) between the detected temperature Ts2 at that time and the saturation temperature Te at that time is equal to or lower than a predetermined threshold value ΔT1. When it is judged that the difference is equal to or lower than the predetermined threshold value ΔT1, it is regarded that the refrigerant cylinder 90 that is not empty is connected, and the procedure proceeds to step S53. Note that it may be possible to adopt a configuration in which the inputting operation or the like by the operator can be omitted by judging that the automatic refrigerant charging operation and judgment on detection of the empty state of the refrigerant cylinder have been started and the refrigerant cylinder 90 has been connected, with a detected rapid drop in the temperature Te2 detected by the downstream temperature sensor 92 as a trigger.

In step S53, the controller 8 evaluates a result of judgment on the refrigerant charging amount in step S13, and judges whether or not the refrigerant quantity in the refrigerant circuit 10 has reached the target charging value Ms. When it is judged that the target charging value Ms has been reached, the controller 8 regards that charging of the necessary amount of refrigerant for the refrigerant circuit 10 is completed and finishes the automatic refrigerant charging operation. On the other hand, when it is judged that the refrigerant quantity has not reached the target charging value Ms, the procedure proceeds to step S54.

In step S54, whether or not the refrigerant cylinder 90 connected to the refrigerant circuit 10 is emptied is judged. As described above, at first when the automatic refrigerant charging operation is started and the refrigerant cylinder 90 is connected, the refrigerant cylinder 90 contains a large amount of liquid refrigerant inside. Thus, the refrigerant supplied to the refrigerant circuit 10 is in a liquid state. Then, as the automatic refrigerant charging operation from the refrigerant cylinder 90 advances, the amount of the liquid refrigerant in the refrigerant cylinder 90 decreases, and the refrigerant supplied to the refrigerant circuit 10 will be the refrigerant in a gas-liquid two-phase state and a gas state. Consequently, as shown in FIG. 13, such change in the state of the refrigerant that is supplied is detected as a rapid rise in the refrigerant temperature Ts2 detected by the downstream temperature sensor 92, and a value determined by a formula Ts2−Te (superheating degree) increases. Here, the controller 8 judges whether or not a state in which the superheating degree (Ts2−Te) is greater than a value obtained by adding a correction term ϵ to a predetermined threshold value ΔT2 is continued for a predetermined period of time TW. When it is judged that such state is continued, it is judged that the refrigerant cylinder 90 is empty, and procedure proceeds to step S55. Here, the correction term ϵ is a value that takes into consideration the effects of the superheating degree in the vicinity of the outlet of each of the indoor heat exchangers 42 and 52 and the outdoor air temperature.

In step S55, because it has been judged that the refrigerant cylinder 90 is empty, the controller 8 causes the display unit 9 to display a replacement sign that indicates that the refrigerant cylinder 90 needs to be replaced. The operator will know the time to replace the refrigerant cylinder 90 by checking the replacement sign displayed on the display unit 9.

In step S56, the operator replaces the empty refrigerant cylinder 90 connected to the charge port P with a new refrigerant cylinder 90 and resumes refrigerant charging.

In step S57, as is the case in step S52, the refrigerant temperature Ts2 will decrease again as the liquid refrigerant is supplied from the refrigerant cylinder 90. Here, as shown in FIG. 13, the controller 8 again judges whether or not the superheating degree (Ts2−Te) is equal to or lower than the predetermined threshold value ΔT1. When it is judged that the superheating degree is equal to or lower than the predetermined threshold value ΔT1, it is judged that the refrigerant has started being supplied from a new refrigerant cylinder 90 that is not empty, and the procedure proceeds to step S58.

In step S58, the controller 8 causes the display unit 9 to finish displaying the cylinder replacement sign. Thereafter, the procedure returns to step S53, and the automatic refrigerant charging operation is continued.

In this way, additional refrigerant charging continues until the refrigerant quantity reaches the target charging value Ms by replacing the refrigerant cylinder 90 with respect to the refrigerant circuit 10.

Note that, although the display unit 9 during the above described operation informs the operator of various states as the LEDs light on the display, it is not particularly limited to the lighting of the LEDs. It may be configured to inform the operator by outputting display to the display or outputting a buzzer sound or the like.

(Step S2: Pipe Volume Judging Operation)

Figure 6:
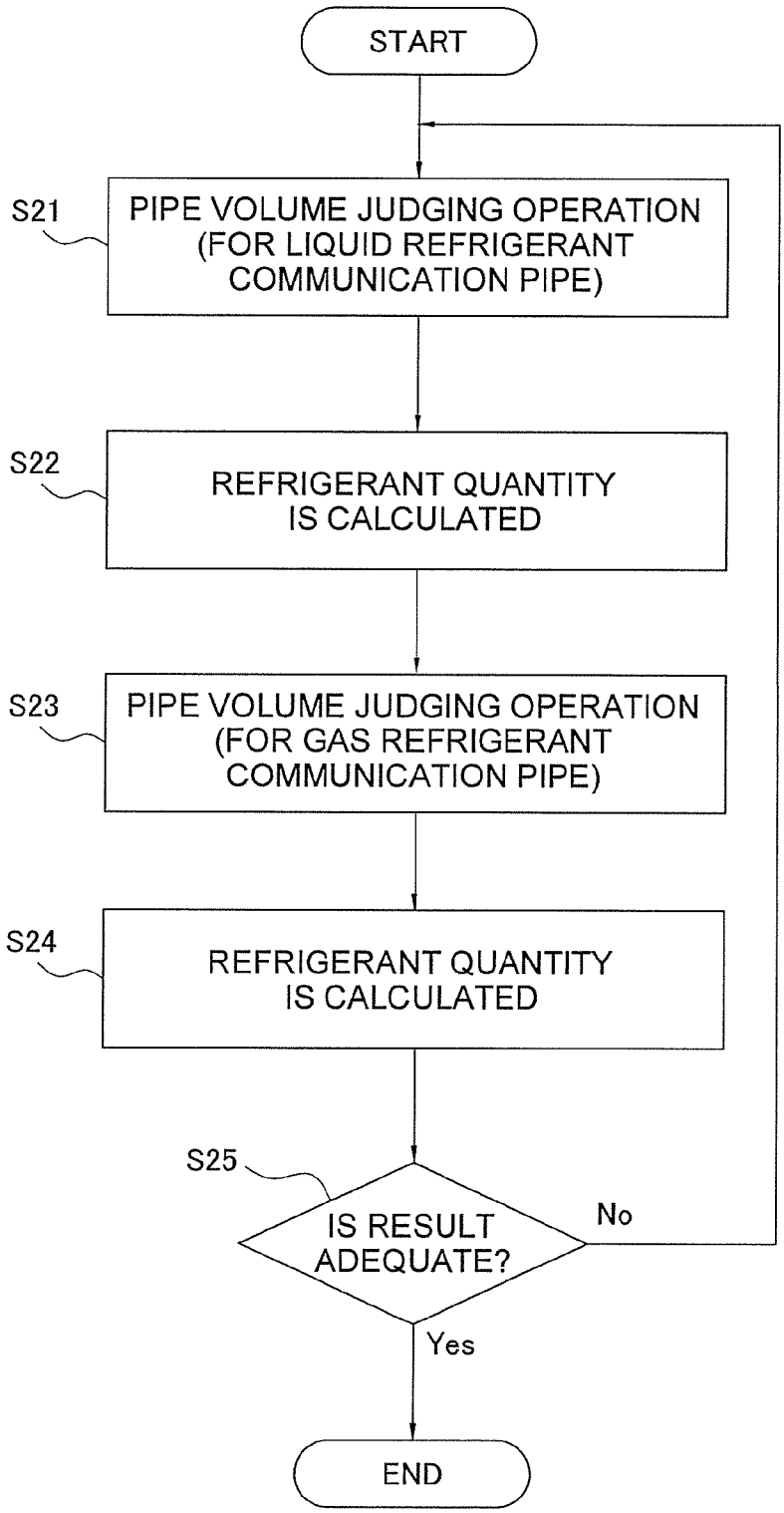
FIG. 6 is a flowchart of a pipe volume judging operation.

When the above described automatic refrigerant charging operation in Step S1 is completed, the process proceeds to the pipe volume judging operation in Step S2. In the pipe volume judging operation as described above, the process from Step S21 to Step S25 as shown in FIG. 6 is performed by the controller 8. Here, FIG. 6 is a flowchart of the pipe volume judging operation.

(Steps S21, S22: Pipe Volume Judging Operation for Liquid Refrigerant Communication Pipe and Volume Calculation)

Figure 7:
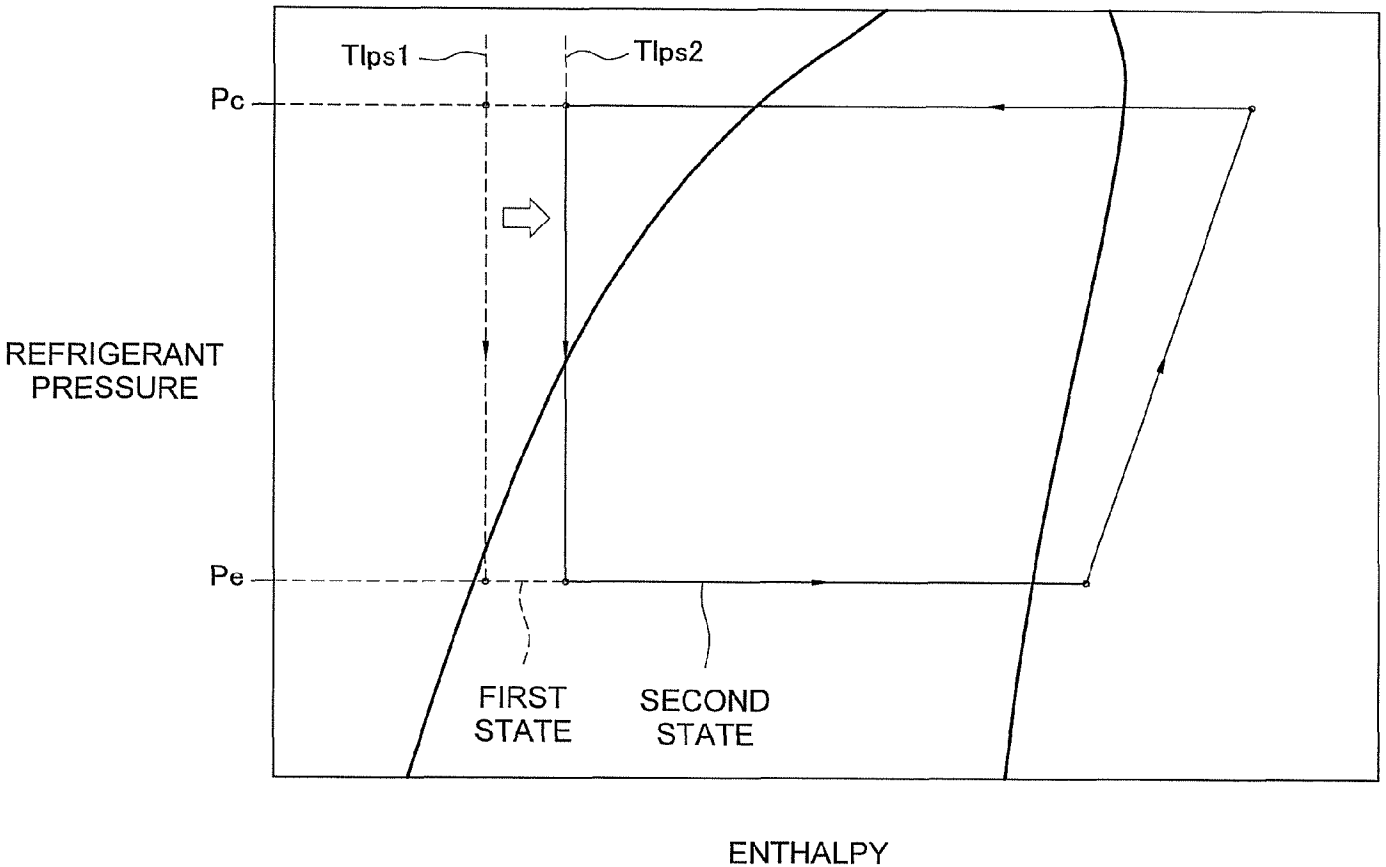
FIG. 7 is a Mollier diagram to show a refrigerating cycle of the air conditioner in the pipe volume judging operation for a liquid refrigerant communication pipe.

In Step S21, as is the case with the above described refrigerant quantity judging operation in Step S11 of the automatic refrigerant charging operation, the pipe volume judging operation for the liquid refrigerant communication pipe 6 as described above, including the all indoor unit operation, condensation pressure control, liquid pipe temperature control, superheating degree control, and evaporation pressure control, is performed. Here, the target liquid pipe temperature Tlps of the temperature Tlp of the refrigerant at the outlet on the main refrigerant circuit side of the subcooler 25 in the liquid pipe temperature control is regarded as a first target value Tlps1, and the state where the refrigerant quantity judging operation is stable at this first target value Tlps1 is regarded as a first state (see the refrigerating cycle indicated by the lines including the dotted lines in FIG. 7). Note that, FIG. 7 is a Mollier diagram to show the refrigerating cycle of the air conditioner 1 in the pipe volume judging operation for the liquid refrigerant communication pipe.

Next, the first state where the temperature Tlp of the refrigerant at the outlet on the main refrigerant circuit side of the subcooler 25 in liquid pipe temperature control is stable at the first target value Tlps1 is switched to a second state (see the refrigerating cycle indicated by the solid lines in FIG. 7) where the target liquid pipe temperature Tlps is changed to a second target value Tlps2 different from the first target value Tlps1 and stabilized without changing the conditions for other equipment controls, i.e., the conditions for the condensation pressure control, superheating degree control, and evaporation pressure control (i.e., without changing the target superheating degree SHrs and the target low pressure Tes). In the present embodiment, the second target value Tlps2 is a temperature higher than the first target value Tlps1.

In this way, by changing from the stable state at the first state to the second state, the density of the refrigerant in the liquid refrigerant communication pipe 6 decreases, and therefore a refrigerant quantity Mlp in the liquid refrigerant communication pipe portion B3 in the second state decreases compared to the refrigerant quantity in the first state. Then, the refrigerant whose quantity has decreased in the liquid refrigerant communication pipe portion B3 moves to other portions in the refrigerant circuit 10. More specifically, as described above, the conditions for other equipment controls other than the liquid pipe temperature control are not changed, and therefore the refrigerant quantity Mog1 in the high-pressure gas pipe portion E, the refrigerant quantity Mog2 in the low-pressure gas pipe portion H, and the refrigerant quantity Mgp in the gas refrigerant communication pipe portion G are maintained substantially constant, and the refrigerant whose quantity has decreased in the liquid refrigerant communication pipe portion B3 will move to the condenser portion A, the high temperature liquid pipe portion B1, the low temperature liquid pipe portion B2, the indoor unit portion F, and the bypass circuit portion I. In other words, the refrigerant quantity Mc in the condenser portion A, the refrigerant quantity Mol1 in the high temperature liquid pipe portion B1, the refrigerant quantity Mol2 in the low temperature liquid pipe portion B2, the refrigerant quantity Mr in the indoor unit portion F, and the refrigerant quantity Mob in the bypass circuit portion I will increase by the quantity of the refrigerant that has decreased in the liquid refrigerant communication pipe portion B3.

Such control as described above is performed as the process in Step S21 by the controller 8 (more specifically, by the indoor side controllers 47 and 57, the outdoor side controller 37, and the transmission line 8*a* that connects between the controllers 37, 47 and 57) that functions as pipe volume judging operation controlling means for performing the pipe volume judging operation to calculate the refrigerant volume Mlp of the liquid refrigerant communication pipe 6.

Next in Step S22, the volume Vlp of the liquid refrigerant communication pipe 6 is calculated by utilizing a phenomenon that the refrigerant quantity in the liquid refrigerant communication pipe portion B3 decreases and the refrigerant whose quantity has decreased moves to other portions in the refrigerant circuit 10 because of the change from the first state to the second state.

First, a calculation formula used in order to calculate the volume Vlp of the liquid refrigerant communication pipe 6 is described. Provided that the quantity of the refrigerant that has decreased in the liquid refrigerant communication pipe portion B3 and moved to the other portions in the refrigerant circuit 10 by the above described pipe volume judging operation is a refrigerant increase/decrease quantity ΔMlp, and that the increase/decrease quantity of the refrigerant in each portion between the first state and the second state is ΔMc, ΔMol1, ΔMol2, ΔMr, and ΔMob (here, the refrigerant quantity Mog1, the refrigerant quantity Mog2, and the refrigerant quantity Mgp are omitted because they are maintained substantially constant), the refrigerant increase/decrease quantity ΔMlp can be, for example, calculated by the following function expression:

$$\Delta Mlp=-(\Delta Mc+\Delta Mol1+\Delta Mol2+\Delta Mr+\Delta Mob).$$

Then, this ΔMlp value is divided by a density change quantity Δρlp of the refrigerant between the first state and the second state in the liquid refrigerant communication pipe 6, and thereby the volume Vlp of the liquid refrigerant communication pipe 6 can be calculated. Note that, although there is little effect on a calculation result of the refrigerant increase/decrease quantity ΔMlp, the refrigerant quantity Mog1 and the refrigerant quantity Mog2 may be included in the above described function expression.

$$Vlp=\Delta Mlp/\Delta\rho lp$$

Note that, ΔMc, ΔMol1, ΔMol2, ΔMr, and ΔMob can be obtained by calculating the refrigerant quantity in the first state and the refrigerant quantity in the second state by using the above described relational expression for each portion in the refrigerant circuit 10 and further by subtracting the refrigerant quantity in the first state from the refrigerant quantity in the second state. In addition, the density change quantity Δρlp can be obtained by calculating the density of the refrigerant at the outlet of the subcooler 25 in the first state and the density of the refrigerant at the outlet of the subcooler 25 in the second state and further by subtracting the density of the refrigerant in the first state from the density of the refrigerant in the second state.

By using the calculation formula as described above, the volume Vlp of the liquid refrigerant communication pipe 6 can be calculated from the operation state quantity of constituent equipment or refrigerant flowing in the refrigerant circuit 10 in the first and second states.

Note that, in the present embodiment, the state is changed such that the second target value Tlps2 in the second state becomes a temperature higher than the first target value Tlps1 in the first state and therefore the refrigerant in the liquid refrigerant communication pipe portion B3 is moved to other portions in order to increase the refrigerant quantity in the other portions; thereby the volume Vlp in the liquid refrigerant communication pipe 6 is calculated from the increased quantity. However, without being limited thereto, the state may be changed such that the second target value Tlps2 in the second state becomes a temperature lower than the first target value Tlps1 in the first state and therefore the refrigerant is moved from other portions to the liquid refrigerant communication pipe portion B3 in order to decrease the refrigerant quantity in the other portions; thereby the volume Vlp in the liquid refrigerant communication pipe 6 is calculated from the decreased quantity.

In this way, the process in Step S22 is performed by the controller 8 that functions as the pipe volume calculating means for the liquid refrigerant communication pipe, which calculates the volume Vlp of the liquid refrigerant communication pipe 6 from the operation state quantity of constituent equipment or refrigerant flowing in the refrigerant circuit 10 in the pipe volume judging operation for the liquid refrigerant communication pipe 6.

(Steps S23, S24: Pipe Volume Judging Operation and Volume Calculation for the Gas Refrigerant Communication Pipe)

After the above described Step S21 and Step S22 are completed, the pipe volume judging operation for the gas refrigerant communication pipe 7, including the all indoor unit operation, condensation pressure control, liquid pipe temperature control, superheating degree control, and evaporation pressure control, is performed in Step S23. Here, the target low pressure Pes of the suction pressure Ps of the compressor 21 in the evaporation pressure control is regarded as a first target value Pes1, and the state where the refrigerant quantity judging operation is stable at this first target value Pes1 is regarded as a first state (see the refrigerating cycle indicated by the lines including the dotted lines in FIG. 8). Note that FIG. 8 is a Mollier diagram to show the refrigerating cycle of the air conditioner 1 in the pipe volume judging operation for the gas refrigerant communication pipe.

Figure 8:
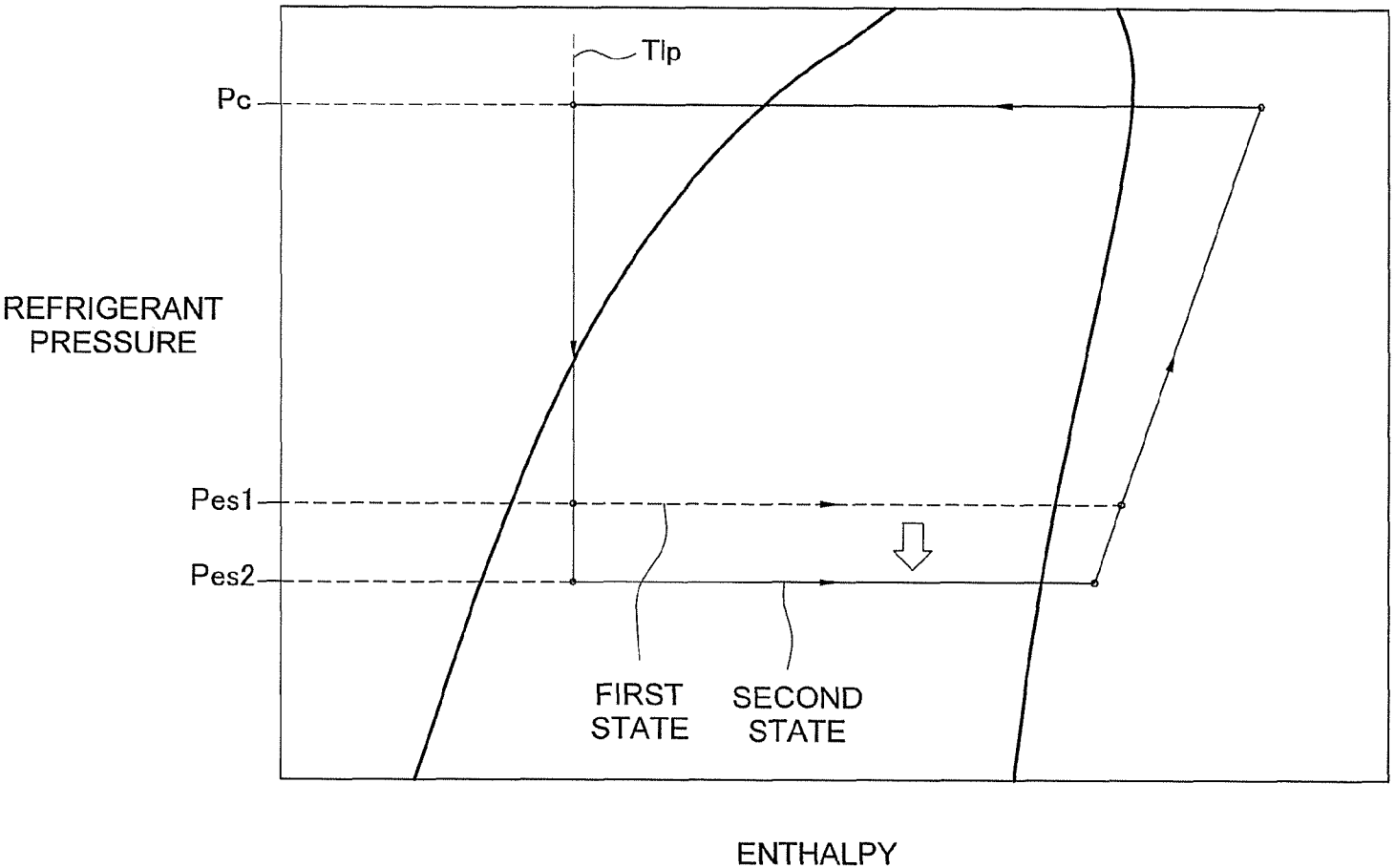
FIG. 8 is a Mollier diagram to show a refrigerating cycle of the air conditioner in the pipe volume judging operation for a gas refrigerant communication pipe.

Next, the first state where the target low pressure Pes of the suction pressure Ps in the compressor 21 in evaporation pressure control is stable at the first target value Pes1 is switched to a second state (see the refrigerating cycle indicated by only the solid lines in FIG. 8) where the target low pressure Pes is changed to a second target value Pes2 different from the first target value Pes1 and stabilized without changing the conditions for other equipment controls, i.e., without changing the conditions for the liquid pipe temperature control, the condensation pressure control, and the superheating degree control (i.e., without changing target liquid pipe temperature Tlps and target superheating degree SHrs). In the present embodiment, the second target value Pes2 is a pressure lower than the first target value Pes1.

In this way, by changing the target value Pes from the stable state at the first state to the second state, the density of the refrigerant in the gas refrigerant communication pipe 7 decreases, and therefore the refrigerant quantity Mgp in the gas refrigerant communication pipe portion G in the second state decreases compared to the refrigerant quantity in the first state. Then, the refrigerant whose quantity has decreased in the gas refrigerant communication pipe portion G will move to other portions in the refrigerant circuit 10. More specifically, as described above, the conditions for other equipment controls other than the evaporation pressure control are not changed, and therefore the refrigerant quantity Mog1 in the high pressure gas pipe portion E, the refrigerant quantity Mol1 in the high-temperature liquid pipe portion B1, the refrigerant quantity Mol2 in the low temperature liquid pipe portion B2, and the refrigerant quantity Mlp in the liquid refrigerant communication pipe portion B3 are maintained substantially constant, and the refrigerant whose quantity has decreased in the gas refrigerant communication pipe portion G will move to the low-pressure gas pipe portion H, the condenser portion A, the indoor unit portion F, and the bypass circuit portion I. In other words, the refrigerant quantity Mog2 in the low-pressure gas pipe portion H, the refrigerant quantity Mc in the condenser portion A, the refrigerant quantity Mr in the indoor unit portion F, and the refrigerant quantity Mob in the bypass circuit portion I will increase by the quantity of the refrigerant that has decreased in the gas refrigerant communication pipe portion G.

Such control as described above is performed as the process in Step S23 by the controller 8 (more specifically, by the indoor side controllers 47 and 57, the outdoor side controller 37, and the transmission line 8*a* that connects between the controllers 37 and 47, and 57) that functions as the pipe volume judging operation controlling means for performing the pipe volume judging operation to calculate the volume Vgp of the gas refrigerant communication pipe 7.

Next in Step S24, the volume Vgp of the gas refrigerant communication pipe 7 is calculated by utilizing a phenomenon that the refrigerant quantity in the gas refrigerant communication pipe portion G decreases and the refrigerant whose quantity has decreased moves to other portions in the refrigerant circuit 10 because of the change from the first state to the second state.

First, a calculation formula used in order to calculate the volume Vgp of the gas refrigerant communication pipe 7 is described. Provided that the quantity of the refrigerant that has decreased in the gas refrigerant communication pipe portion G and moved to the other portions in the refrigerant circuit 10 by the above described pipe volume judging operation is a refrigerant increase/decrease quantity ΔMgp, and that increase/decrease quantities of the refrigerant in respective portion between the first state and the second state are ΔMc, ΔMog2, ΔMr, and ΔMob (here, the refrigerant quantity Mog1, the refrigerant quantity Mol1, the refrigerant quantity Mol2, and the refrigerant quantity Mlp are omitted because they are maintained substantially constant), the refrigerant increase/decrease quantity ΔMgp can be, for example, calculated by the following function expression:

$$\Delta Mgp=-(\Delta Mc+\Delta Mog2+\Delta Mr+\Delta Mob).$$

Then, this ΔMgp value is divided by a density change quantity Δρgp of the refrigerant between the first state and the second state in the gas refrigerant communication pipe 7, and thereby the volume Vgp of the gas refrigerant communication pipe 7 can be calculated. Note that, although there is little effect on a calculation result of the refrigerant increase/decrease quantity ΔMgp, the refrigerant quantity Mog1, the refrigerant quantity Mol1, and the refrigerant quantity Mol2 may be included in the above described function expression.

$$Vgp=\Delta Mgp/\Delta\rho gp$$

Note that, ΔMc, ΔMog2, ΔMr and ΔMob can be obtained by calculating the refrigerant quantity in the first state and the refrigerant quantity in the second state by using the above described relational expression for each portion in the refrigerant circuit 10 and further by subtracting the refrigerant quantity in the first state from the refrigerant quantity in the second state. In addition, the density change quantity $\Delta\rho gp$ can be obtained by calculating an average density between the density $\rho s$ of the refrigerant at the suction side of the compressor 21 in the first state and the density $\rho eo$ of the refrigerant at the outlets of the indoor heat exchangers 42 and 52 in the first state and by subtracting the average density in the first state from the average density in the second state.

By using such calculation formula as described above, the volume Vgp of the gas refrigerant communication pipe 7 can be calculated from the operation state quantity of constituent equipment or refrigerant flowing in the refrigerant circuit 10 in the first and second states.

Note that, in the present embodiment, the state is changed such that the second target value Pes2 in the second state becomes a pressure lower than the first target value Pest in the first state and therefore the refrigerant in the gas refrigerant communication pipe portion G is moved to other portions in order to increase the refrigerant quantity in the other portions; thereby the volume Vlp of the gas refrigerant communication pipe 7 is calculated from the increased quantity. However, without being limited thereto, the state may be changed such that the second target value Pes2 in the second state becomes a pressure higher than the first target value Pes1 in the first state and therefore the refrigerant is moved from other portions to the gas refrigerant communication pipe portion G in order to decrease the refrigerant quantity in the other portions; thereby the volume Vlp in the gas refrigerant communication pipe 7 is calculated from the decreased quantity.

In this way, the process in Step S24 is performed by the controller 8 that functions as the pipe volume calculating means for the gas refrigerant communication pipe, which calculates the volume Vgp of the gas refrigerant communication pipe 7 from the operation state quantity of constituent equipment or refrigerant flowing in the refrigerant circuit 10 in the pipe volume judging operation for the gas refrigerant communication pipe 7.

(Step S25: Adequacy Judgment on the Pipe Volume Judging Operation Result)

After the above described Step S21 to Step S24 are completed, Step S25 is performed to judge whether or not a result of the pipe volume judging operation is adequate, in other words, whether or not the volumes Vlp, Vgp of the refrigerant communication pipes 6 and 7 calculated by the pipe volume calculating means are adequate.

Specifically, as shown in an inequality expression below, judgment is made based on whether or not the ratio of the volume Vlp of the liquid refrigerant communication pipe 6 to the volume Vgp of the gas refrigerant communication pipe 7 obtained by the calculations is in a predetermined numerical value range.

$$\epsilon 1 < Vlp/Vgp < \epsilon 2$$

Here, $\epsilon 1$ and $\epsilon 2$ are values that are changed based on the minimum value and the maximum value of the pipe volume ratio in feasible combinations of the heat source unit and the utilization units.

Then, when the volume ratio Vlp/Vgp satisfies the above described numerical value range, the process in Step S2 of the pipe volume judging operation is completed. When the volume ratio Vlp/Vgp does not satisfy the above described numerical value range, the process for the pipe volume judging operation and volume calculation in Step S21 to Step S24 is performed again.

In this way, the process in Step S25 is performed by the controller 8 that functions as the adequacy judging means for judging whether or not a result of the above described pipe volume judging operation is adequate, in other words, whether or not the volumes Vlp. Vgp of the refrigerant communication pipes 6 and 7 calculated by the pipe volume calculating means are adequate.

Note that, in the present embodiment, the pipe volume judging operation (Steps S21, S22) for the liquid refrigerant communication pipe 6 is first performed and then the pipe volume judging operation for the gas refrigerant communication pipe 7 (Steps S23, S24) is performed. However, the pipe volume judging operation for the gas refrigerant communication pipe 7 may be performed first.

In addition, in the above described Step S25, when a result of the pipe volume judging operation in Steps S21 to S24 is judged to be inadequate for a plurality of times, or when it is desired to more simply judge the volumes Vlp, Vgp of the refrigerant communication pipes 6 and 7, although it is not shown in FIG. 6, for example, in Step S25, after a result of the pipe volume judging operation in Steps S21 to S24 is judged to be inadequate, it is possible to proceed to the process for estimating the lengths of the refrigerant communication pipes 6 and 7 from the pressure loss in the refrigerant communication pipes 6 and 7 and calculating the volumes Vlp, Vgp of the refrigerant communication pipes 6 and 7 from the estimated pipe lengths and an average volume ratio, thereby obtaining the volumes Vlp, Vgp of the refrigerant communication pipes 6 and 7.

In addition, in the present embodiment, the case where the pipe volume judging operation is performed to calculate the volumes Vlp, Vgp of the refrigerant communication pipes 6 and 7 is described on the premise that there is no information regarding the lengths, pipe diameters and the like of the refrigerant communication pipes 6 and 7 and the volumes Vlp, Vgp of the refrigerant communication pipes 6 and 7 are unknown. However, when the pipe volume calculating means has a function to calculate the volumes Vlp, Vgp of the refrigerant communication pipes 6 and 7 by inputting information regarding the lengths, pipe diameters and the like of the refrigerant communication pipes 6 and 7, such function may be used together.

Further, when the above described function to calculate the volumes Vlp, Vgp of the refrigerant communication pipes 6 and 7 by using the pipe volume judging operation and the operation results thereof is not used but only the function to calculate the volumes Vlp, Vgp of the refrigerant communication pipes 6 and 7 by inputting information regarding the lengths, pipe diameters and the like of the refrigerant communication pipes 6 and 7 is used, the above described adequacy judging means (Step 25) may be used to judge whether or not the input information regarding the lengths, pipe diameters and the like of the refrigerant communication pipes 6 and 7 is adequate.

(Step S3: Initial Refrigerant Quantity Detection Operation)

Figure 9:
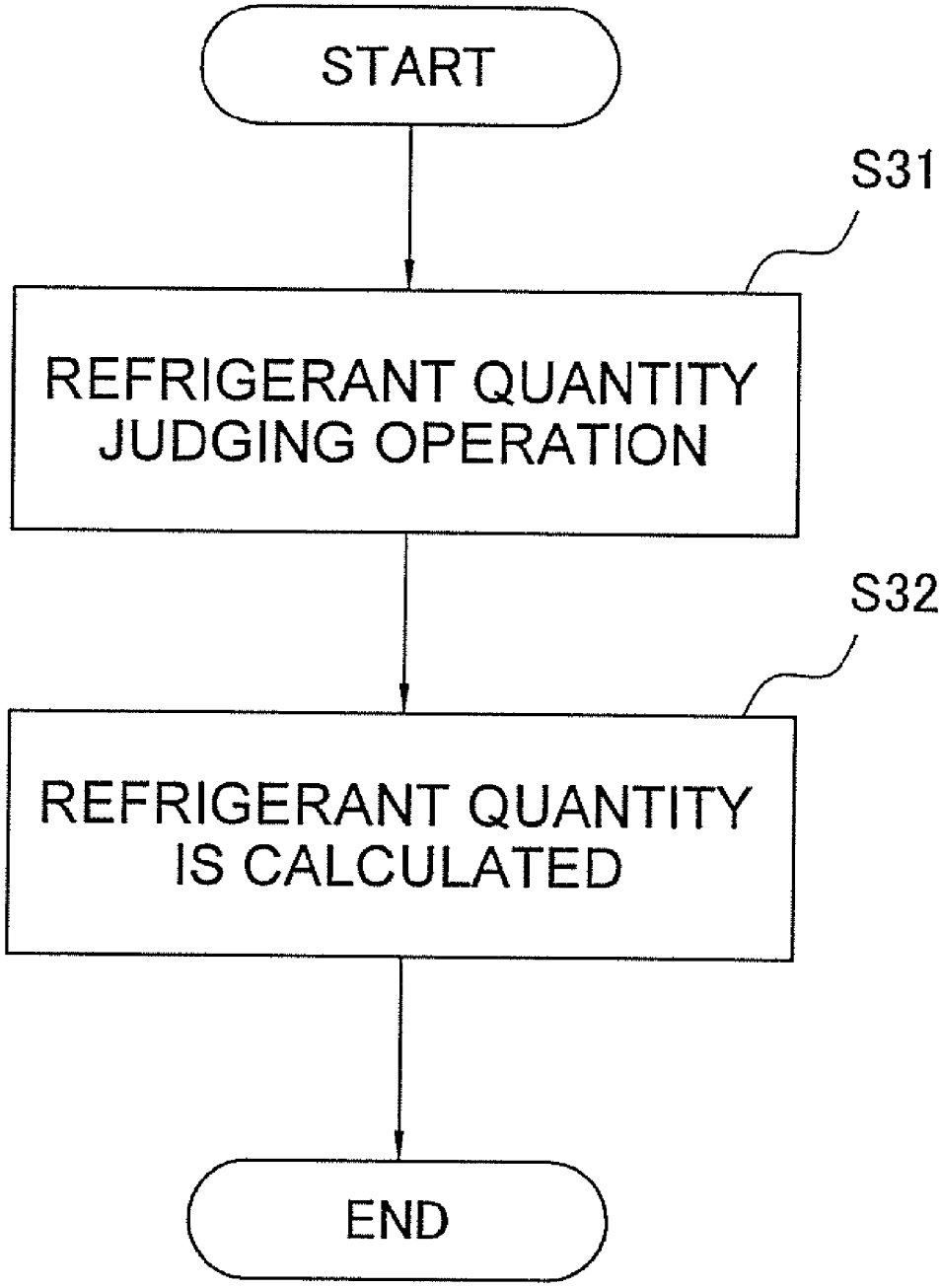
FIG. 9 is a flowchart of an initial refrigerant quantity judging operation.

When the above described pipe volume judging operation in Step S2 is completed, the process proceeds to an initial refrigerant quantity judging operation in Step S3. In the initial refrigerant quantity detection operation, the process in Step S31 and Step S32 shown in FIG. 9 is performed by the controller 8. Here, FIG. 9 is a flowchart of the initial refrigerant quantity detection operation.

(Step S31: Refrigerant Quantity Judging Operation)

In Step S31, as is the case with the above described refrigerant quantity judging operation in Step S11 of the automatic refrigerant charging operation, the refrigerant quantity judging operation, including the all indoor unit operation, condensation pressure control, liquid pipe temperature control, superheating degree control, and evaporation pressure control, is performed. Here, as a rule, values that are the same as the target values in the refrigerant quantity judging operation in Step S11 of the automatic refrigerant charging operation are used for the target liquid pipe temperature Tlps in the liquid pipe temperature control, the target superheating degree SHrs in the superheating degree control, and the target low pressure Pes in the evaporation pressure control.

In this way, the process in Step S31 is performed by the controller 8 that functions as the refrigerant quantity judging operation controlling means for performing the refrigerant quantity judging operation, including the all indoor unit operation, condensation pressure control, liquid pipe temperature control, superheating degree control, and evaporation pressure control.

(Step S32: Refrigerant Quantity Calculation)

Next, the refrigerant quantity in the refrigerant circuit 10 is calculated from the operation state quantity of constituent equipment or refrigerant flowing in the refrigerant circuit 10 in the initial refrigerant quantity judging operation in Step S32 by the controller 8 that functions as the refrigerant quantity calculating means while performing the above described refrigerant quantity judging operation. Calculation of the refrigerant quantity in the refrigerant circuit 10 is performed by using the above described relational expressions between the refrigerant quantity in each portion in the refrigerant circuit 10 and the operation state quantity of constituent equipment or refrigerant flowing in the refrigerant circuit 10. However, at this time, the volumes Vlp and Vgp of the refrigerant communication pipes 6 and 7, which were unknown at the time of after installation of constituent equipment of the air conditioner 1, have been calculated and the values thereof are known by the above described pipe volume judging operation. Thus, by multiplying the volumes Vlp and Vgp of the refrigerant communication pipes 6 and 7 by the density of the refrigerant, the refrigerant quantities Mlp, Mgp in the refrigerant communication pipes 6 and 7 can be calculated, and further by adding the refrigerant quantity in the other each portion, the initial refrigerant quantity in the entire refrigerant circuit 10 can be detected. This initial refrigerant quantity is used as a reference refrigerant quantity Mi of the entire refrigerant circuit 10, which serves as the reference for judging whether or not the refrigerant is leaking from the refrigerant circuit 10 in the below described refrigerant leak detection operation. Therefore, it is stored as a value of the operation state quantity in the memory of the controller 8 as state quantity storing means.

In this way, the process in Step S32 is performed by the controller 8 that functions as the refrigerant quantity calculating means for calculating the refrigerant quantity in each portion in the refrigerant circuit 10 from the operation state quantity of constituent equipment or refrigerant flowing in the refrigerant circuit 10 in the initial refrigerant quantity detecting operation.

<Refrigerant Leak Detection Operation Mode>

Figure 10:
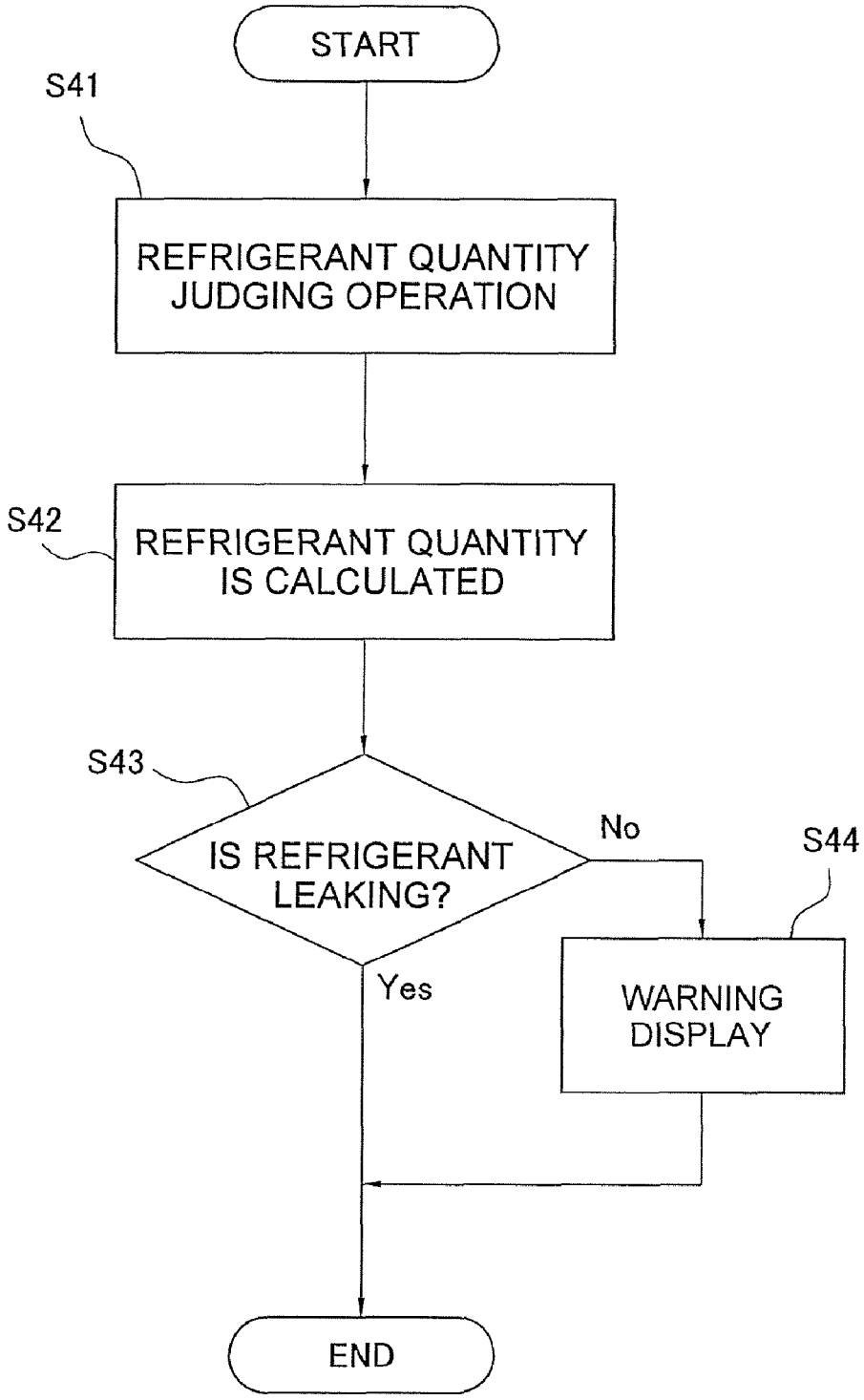
FIG. 10 is a flowchart of a refrigerant leak detection operation mode.

Next, the refrigerant leak detection operation mode is described with reference to FIGS. 1, 2, 5, and 10. Here, FIG. 10 is a flowchart of the refrigerant leak detection operation mode.

In the present embodiment, an example of a case is described where, whether or not the refrigerant in the refrigerant circuit 10 is leaking to the outside due to an unforeseen factor is detected periodically (for example, during a period of time such as on a holiday or in the middle of the night when air conditioning is not needed).

(Step S41: Refrigerant Quantity Judging Operation)

First, when operation in the normal operation mode such as the above described cooling operation and heating operation has gone on for a certain period of time (for example, half a year to a year), the normal operation mode is automatically or manually switched to the refrigerant leak detection operation mode, and as is the case with the refrigerant quantity judging operation of the initial refrigerant quantity detection operation, the refrigerant quantity judging operation, including the all indoor unit operation, condensation pressure control, liquid pipe temperature control, superheating degree control, and evaporation pressure control, is performed. Here, as a rule, values that are the same as the target values in Step S31 of the refrigerant quantity judging operation of the initial refrigerant quantity detection operation are used for the target liquid pipe temperature Tlps in the liquid pipe temperature control, the target superheating degree SHrs in the superheating degree control, and the target low pressure Pes in the evaporation pressure control.

Note that, this refrigerant quantity judging operation is performed for each time the refrigerant leak detection operation is performed. Even when the refrigerant temperature Tco at the outlet of the outdoor heat exchanger 23 fluctuates due to the different operating conditions, for example, such as when the condensation pressure Pc is different or when the refrigerant is leaking, the refrigerant temperature Tlp in the liquid refrigerant communication pipe 6 is maintained constant at the same target liquid pipe temperature Tlps by the liquid pipe temperature control.

In this way, the process in Step S41 is performed by the controller 8 that functions as the refrigerant quantity judging operation controlling means for performing the refrigerant quantity judging operation, including the all indoor unit operation, condensation pressure control, liquid pipe temperature control, superheating degree control, and evaporation pressure control.

(Step S42: Refrigerant Quantity Calculation)

Next, the refrigerant quantity in the refrigerant circuit 10 is calculated from the operation state quantity of constituent equipment or refrigerant flowing in the refrigerant circuit 10 in the refrigerant leak detection operation in Step S42 by the controller 8 that functions as the refrigerant quantity calculating means while performing the above described refrigerant quantity judging operation. Calculation of the refrigerant quantity in the refrigerant circuit 10 is performed by using the above described relational expression between the refrigerant quantity in each portion in the refrigerant circuit 10 and the operation state quantity of constituent equipment or refrigerant flowing in the refrigerant circuit 10. At this time, as is the case with the initial refrigerant quantity judging operation, the volumes Vlp and Vgp of the refrigerant communication pipes 6 and 7, which were unknown at the time of after installation of constituent equipment of the air conditioner 1, have been calculated and the values thereof are known by the above described pipe volume judging operation. Thus, by multiplying the volumes Vlp and Vgp of the refrigerant communication pipes 6 and 7 by the density of the refrigerant, the refrigerant quantities Mlp, Mgp in the refrigerant communication pipes 6 and 7 can be calculated, and further by adding the refrigerant quantity in each other portion, the refrigerant quantity M in the entire refrigerant circuit 10 can be calculated.

Here, as described above, the refrigerant temperature Tlp in the liquid refrigerant communication pipe 6 is maintained constant at the target liquid pipe temperature Tlps by the liquid pipe temperature control. Therefore, regardless the difference in the operating conditions for the refrigerant leak detection operation, the refrigerant quantity Mlp in the liquid refrigerant communication pipe portion B3 will be maintained constant even when the refrigerant temperature Tco at the outlet of the outdoor heat exchanger 23 changes.

In this way, the process in Step S42 is performed by the controller 8 that functions as the refrigerant quantity calculating means for calculating the refrigerant quantity at each portion in the refrigerant circuit 10 from the operation state quantity of constituent equipment or refrigerant flowing in the refrigerant circuit 10 in the refrigerant leak detection operation.

(Steps S43, S44: Adequacy Judgment on the Refrigerant Quantity, Warning Display)

When refrigerant leaks from the refrigerant circuit 10, the refrigerant quantity in the refrigerant circuit 10 decreases. Then, when the refrigerant quantity in the refrigerant circuit 10 decreases, mainly, a tendency of a decrease in the subcooling degree SCo at the outlet of the outdoor heat exchanger 23 appears. Along with this, the refrigerant quantity Mc in the outdoor heat exchanger 23 decreases, and the refrigerant quantities in other portions tend to be maintained substantially constant. Consequently, the refrigerant quantity M of the entire refrigerant circuit 10 calculated in the above described Step S42 is smaller than the reference refrigerant quantity Mi detected in the initial refrigerant quantity detection operation when the refrigerant is leaking from the refrigerant circuit 10; whereas when the refrigerant is not leaking from the refrigerant circuit 10, the refrigerant quantity M is substantially the same as the reference refrigerant quantity Mi.

By utilizing the above-described characteristics, whether or not the refrigerant is leaking is judged in Step S43. When it is judged in Step S43 that the refrigerant is not leaking from the refrigerant circuit 10, the refrigerant leak detection operation mode is finished.

On the other hand, when it is judged in Step S43 that the refrigerant is leaking from the refrigerant circuit 10, the process proceeds to Step S44, and a warning indicating that a refrigerant leak is detected is displayed on the display unit 9. Subsequently, the refrigerant leak detection operation mode is finished.

In this way, the process from Steps S42 to S44 is performed by the controller 8 that functions as the refrigerant leak detection means, which is one of the refrigerant quantity judging means, and which detects whether or not the refrigerant is leaking by judging the adequacy of the refrigerant quantity in the refrigerant circuit 10 while performing the refrigerant quantity judging operation in the refrigerant leak detection operation mode.

Note that, here, when a refrigerant leak is detected, the refrigerant charging operation is carried out after the leakage portion is repaired. The refrigerant charging operation here is the same as the operation procedure at the time of installation described above. The refrigerant is charged into the refrigerant circuit 10 until the refrigerant quantity reaches the target charging value Ms. In addition, it is also the same in that the refrigerant cylinder 90 is replaced with a new refrigerant cylinder 90 each time the refrigerant cylinder 90 is emptied and charging is continued until the target charging value Ms is reached. In addition, the same procedure can be used to allow implementation of re-charging of refrigerant in the case where the refrigerant in the refrigerant circuit 10 is collected for repair on the refrigerant circuit 10 for a reason other than a refrigerant leak and the refrigerant quantity is in a state that does not satisfy the target charging value Ms.

As described above, in the air conditioner 1 in the present embodiment, the controller 8 functions as the refrigerant quantity judging operation means, the refrigerant quantity calculating means, the refrigerant quantity judging means, the pipe volume judging operation means, the pipe volume calculating means, the adequacy judging means, and the state quantity storing means, and thereby configures the refrigerant quantity judging system for judging the adequacy of the refrigerant quantity charged into the refrigerant circuit 10.

<Characteristics of Air Conditioner 1 in this Embodiment>

(1)

With the conventional air conditioner, sometimes a situation occurs where the cylinder is emptied during the refrigerant charging operation and the cylinder needs to be replaced with a new cylinder in order to continue charging. In such a case, in order to judge whether or not the cylinder is emptied, the operator occasionally needs to check the change in the weight of the cylinder using a scale or the like.

As a countermeasure, the air conditioner 1 in this embodiment has the downstream temperature sensor 92 on the downstream side of the charge port P with respect to the refrigerant into the refrigerant circuit 10. Accordingly, the outdoor side controller 37 judges that the refrigerant from the refrigerant cylinder 90 is being charged and whether or not the refrigerant cylinder 90 is emptied based on a change in the temperature detected by the downstream temperature sensor 92, a change in the superheating degree calculated from the downstream temperature sensor 92, or the like (whether or not the superheating degree of the refrigerant is maintained in a state equal to or greater than the predetermined threshold value for the predetermined period of time TW). Additionally, the operator can know that the refrigerant cylinder 90 is emptied by the output from the display unit 9. Accordingly, the operator can know, without paying particular attention, that the refrigerant cylinder 90 is emptied from the display on the display unit 9, without measuring the weight change of the refrigerant cylinder 9 on a scale or the like.

Accordingly, the operator can easily perform the replacement operation of the refrigerant cylinder 90.

In addition, it is not only possible to eliminate the operation to detect the empty state of the refrigerant cylinder 90 using a scale or the like and automatically detect the empty state of the refrigerant cylinder 90, but also it is possible to automatically detect that the refrigerant has been charged into the refrigerant circuit 10 up to the target charging value Ms. Accordingly, the operator can charge the refrigerant quantity of the target charging value Ms into the refrigerant circuit 10 simply by knowing the empty state of the refrigerant cylinder 90 and replacing the refrigerant cylinder 90 with a new refrigerant cylinder 90 several times.

(2)

With the air conditioner 1 in this embodiment, the outdoor side controller 37 automatically judges that refrigerant charging from the refrigerant cylinder 90 has been started when the superheating degree determined from the temperature detected by the downstream temperature sensor 92 falls below the threshold value $\Delta T1$. Further, when a temperature of the refrigerant which is detected by the downstream temperature sensor 92 is similar to an initial temperature when refrigerant charging was started and when the superheating degree of the refrigerant is maintained in a state equal to or greater than the predetermined threshold value for the predetermined period of time TW, the outdoor side controller 37 automatically judges that the refrigerant cylinder 90 is emptied and outputs the judgment on the display 9. Accordingly, the operator can automatically know that the refrigerant cylinder 90 is emptied by the display on the display unit 9.

Alternative Embodiment

While only one embodiment of the present invention has been described, the scope of the invention is not limited to the above-described embodiment, and various changes and modifications can be made herein without departing from the scope of the invention.

(A)

The above described air conditioner 1 is described by taking the detection of the empty state of the refrigerant cylinder 90 as an example in which the downstream temperature sensor 92 is provided only at the downstream of the charge port P and detects the temperature.

Figure 14:
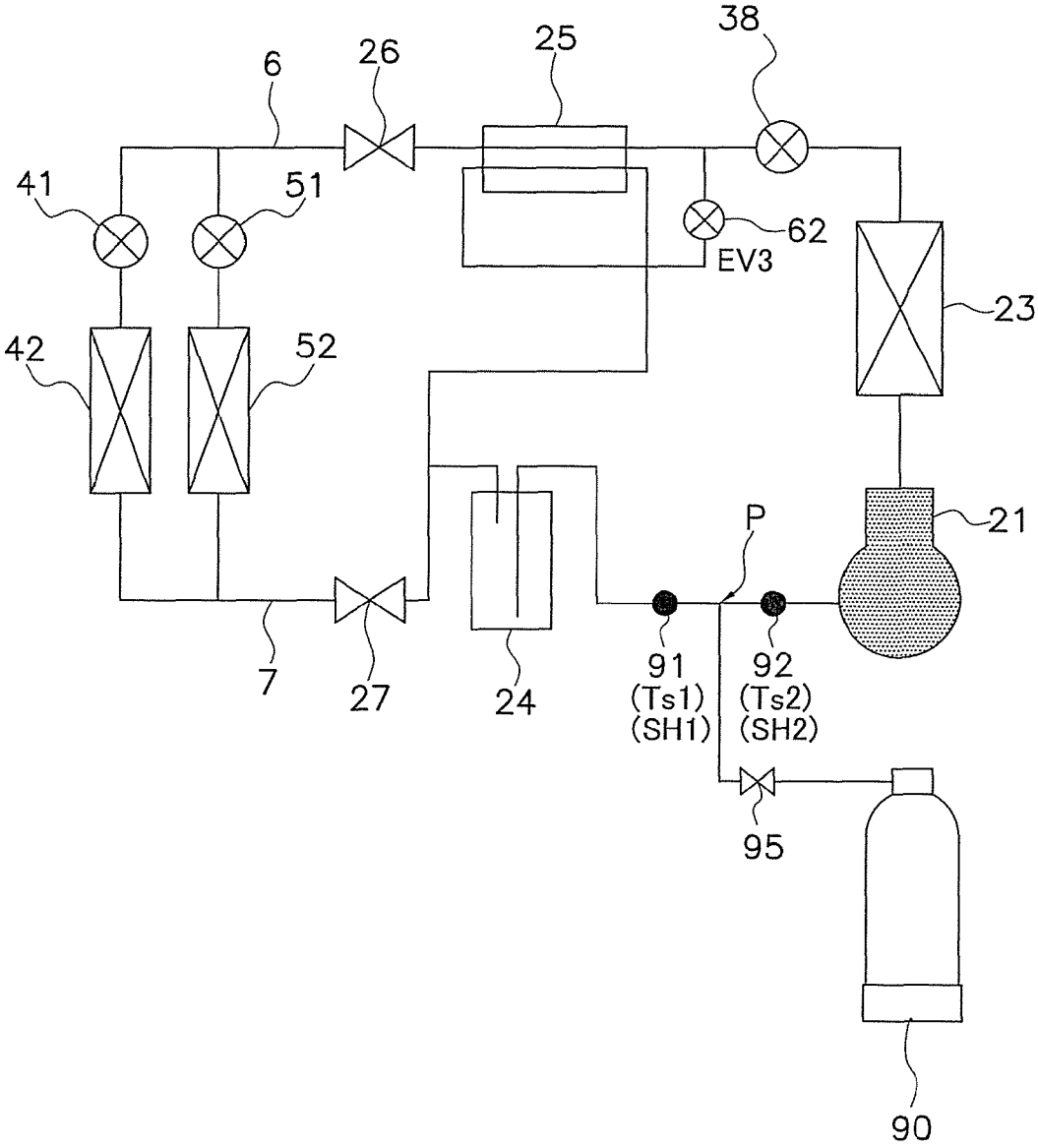
FIG. 14 is a schematic refrigerant circuit diagram in which an air conditioner in alternative embodiment (A) is connected to a cylinder.
Figure 15:
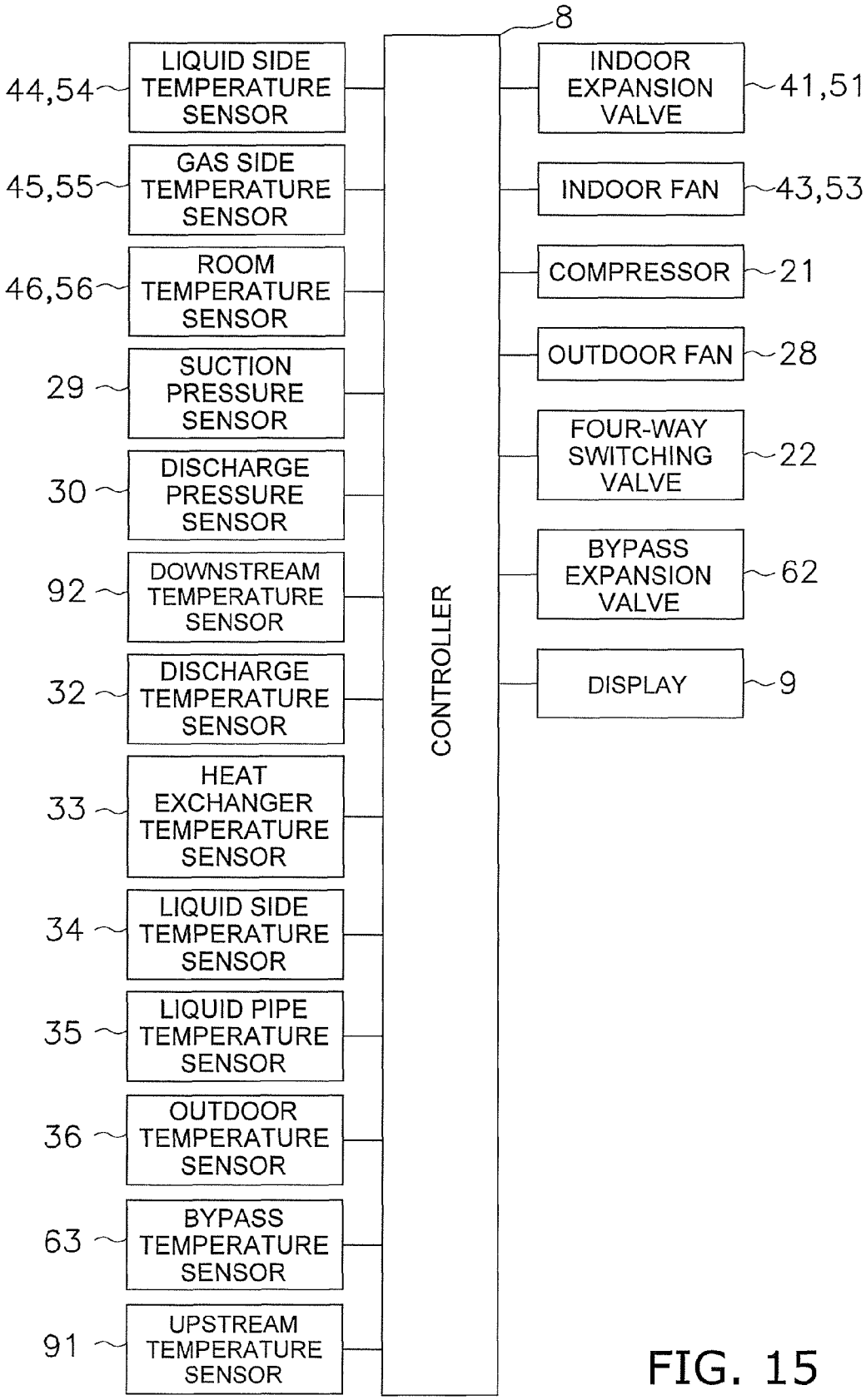
FIG. 15 is a control block diagram of the air conditioner in alternative embodiment (A).

However, the present invention is not limited thereto. As shown in FIG. 14, the present invention may have a configuration in which an upstream temperature sensor 91 is further provided on the upstream side of the charge port P. As is the case of the downstream temperature sensor 92, as shown in FIG. 15, this upstream temperature sensor 91 is connected to the outdoor side controller 37.

By the configuration in which these two temperature sensors 91 and 92 are provided, the empty state of the refrigerant cylinder 90 may be detected based on the difference between the temperatures detected by the upstream temperature sensor 91 and by the downstream temperature sensor 92; the difference between the superheating degrees calculated from the upstream temperature sensor 91 and from the upstream temperature sensor 92; or a change in each of these differences.

Here, it is possible to compare the refrigerant temperature or the superheating degree before the refrigerant from the refrigerant cylinder 90 is mixed with the refrigerant temperature or the superheating degree after the refrigerant from the refrigerant cylinder 90 is mixed. Accordingly, when a value of the state quantity of the refrigerant at the upstream of the charge port P becomes equal to a value of the state quantity of the refrigerant at the downstream of the charge port P or when the change in the state quantity decreases, it can be judged that refrigerant charging from the refrigerant cylinder 90 is completed, and it is possible to more accurately detect that the cylinder 90 is emptied.

(B)

The above described air conditioner 1 is described by taking a case as an example in which the downstream temperature sensor 92 is provided in the main refrigerant circuit and detects the temperature.

Figure 16:
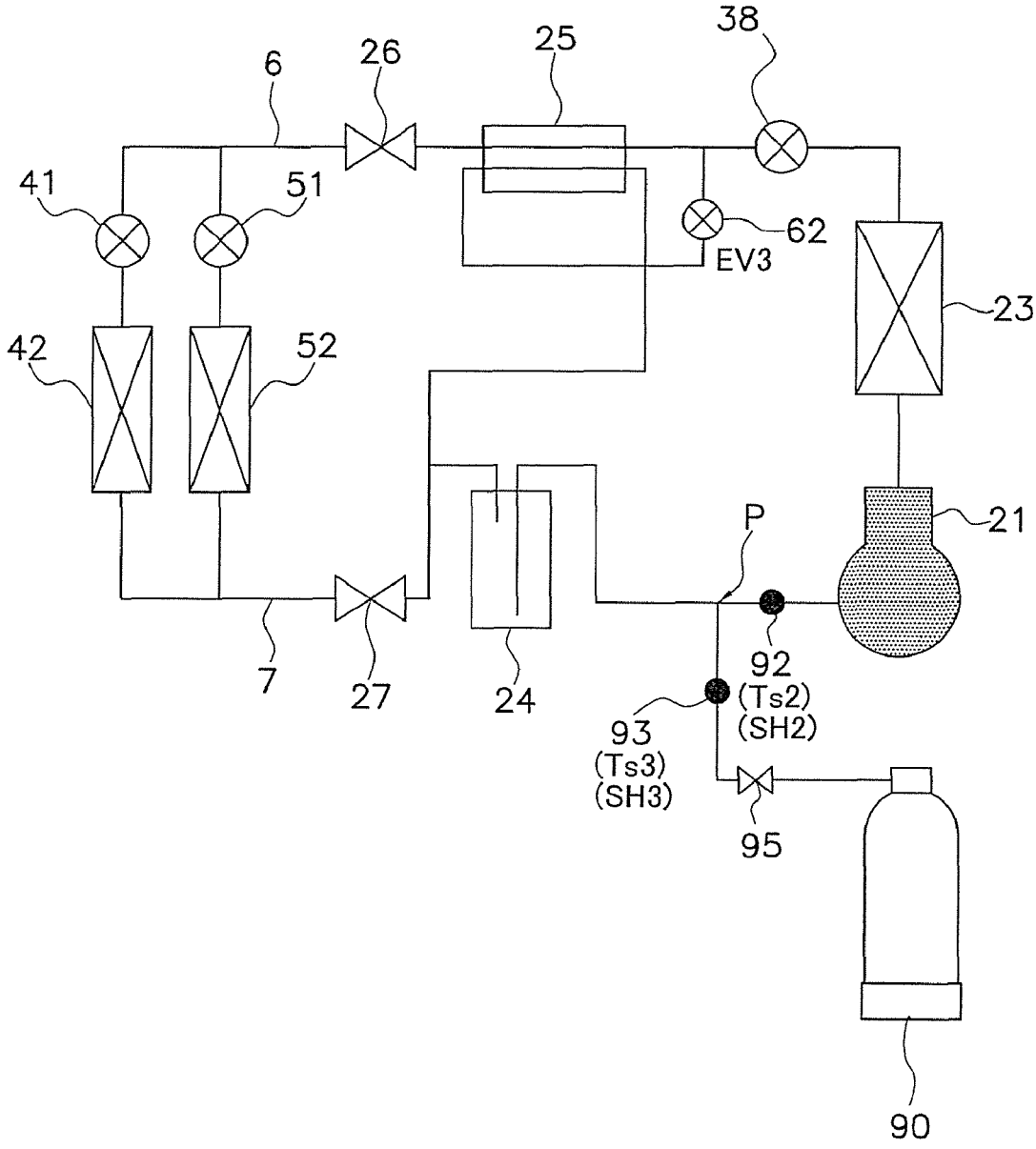
FIG. 16 is a schematic refrigerant circuit diagram in which an air conditioner in alternative embodiment (B) is connected to a cylinder.
Figure 17:
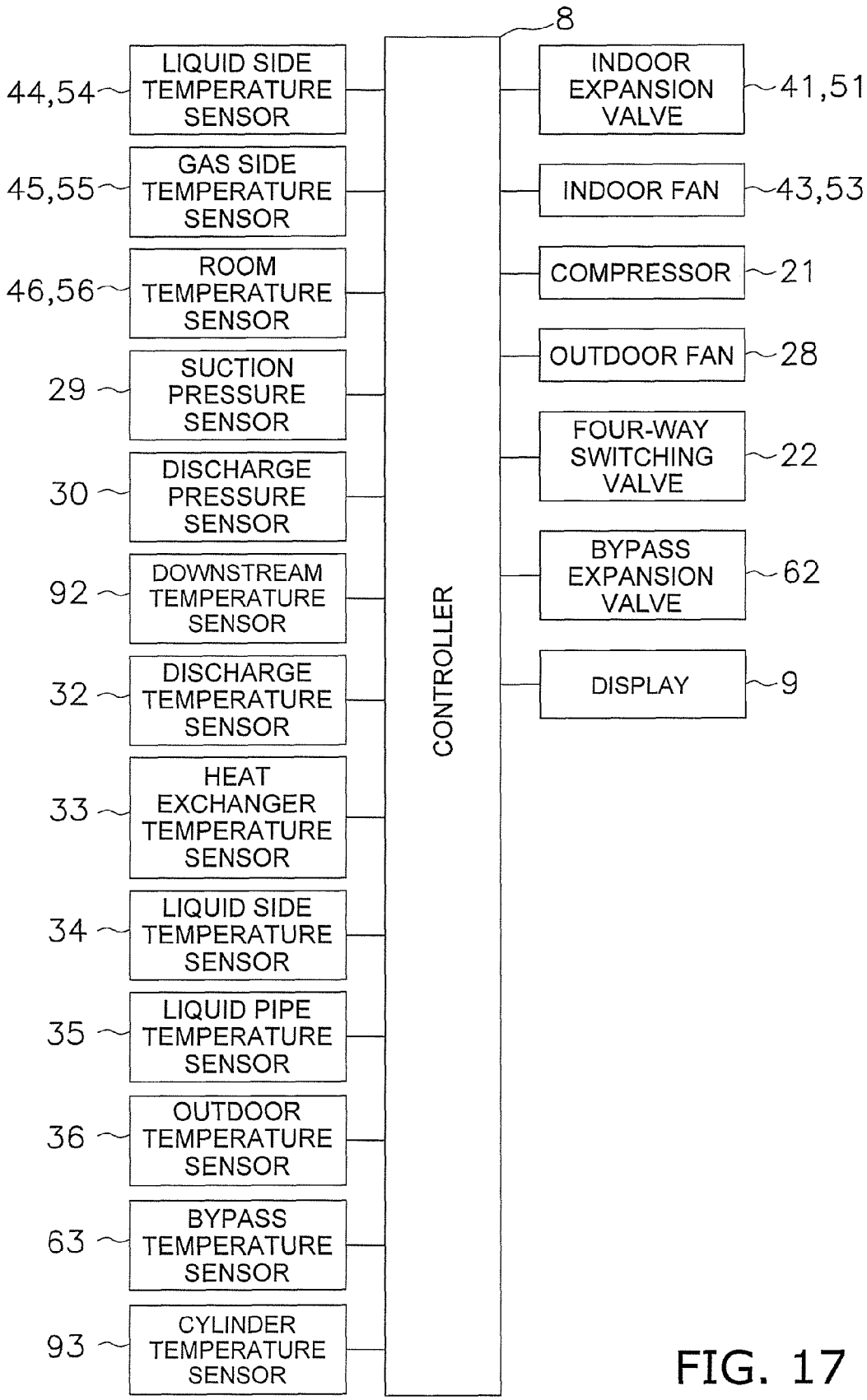
FIG. 17 is a control block diagram of the air conditioner in alternative embodiment (B).

However, the present invention is not limited thereto. As shown in FIG. 16, the present invention may have a configuration in which a cylinder temperature sensor 93 is provided midway of the pipe that interconnects the charge port P and the refrigerant cylinder 90. As is the case of the downstream temperature sensor 92, as shown in FIG. 17, this cylinder temperature sensor 93 is connected to the outdoor side controller 37.

Here, by the cylinder temperature sensor 93, the pipe, and the refrigerant cylinder 90, which are connected to the main refrigerant circuit, the empty state of the refrigerant cylinder 90 may be detected based on the temperature detected by the cylinder temperature sensor 93, the superheating degree of the refrigerant, or a change in each of these differences or the like during the automatic refrigerant charging operation.

Here, in the charging process of the refrigerant from the refrigerant cylinder 90 into the main refrigerant circuit, it is possible to compare the temperature detected at the starting time of charging with the temperature detected at the finishing time of charging which is when the refrigerant cylinder 90 is emptied. Moreover, the cylinder temperature sensor 93 detects the temperature of the refrigerant supplied from the refrigerant cylinder 90 to the charge port P, instead the temperature at the midway of the main refrigerant circuit, so that the cylinder temperature sensor 93 detects a value that is less affected by the flow rate and the temperature of the refrigerant in the main refrigerant circuit. Accordingly, when the change in a value of the state quantity such as the temperature of the refrigerant or the like between the charge port P and the refrigerant cylinder 90 decreases, it can be judged that refrigerant charging from the refrigerant cylinder 90 is completed, and it is possible to more accurately detect that the refrigerant cylinder 90 is emptied.

In addition, it is possible to compare the detected temperature of the liquid refrigerant in a state in which the refrigerant from the refrigerant cylinder 90 starts to be charged with the detected temperature of the gas-liquid mixed refrigerant or the refrigerant in a gas state after some time has elapsed since the start of charging. Accordingly, when a value of the state quantity such as the temperature of the refrigerant or the like between the charge port P and the refrigerant cylinder 90 becomes equal to a value of the state quantity such as the temperature of the refrigerant or the like in the vicinity of the charge port P in the main refrigerant circuit, or when the change in the state quantity decreases, it can be judged that refrigerant charging from the refrigerant cylinder 90 is completed.

INDUSTRIAL APPLICABILITY

Utilization of the present invention allows the operator to know, without paying particular attention, that the cylinder is emptied during refrigerant charging from a cylinder, so that the present invention is particularly useful to be applied to the case when refrigerant is charged from the cylinder in an air conditioner.

What is claimed is:

1. An air conditioner in which the refrigerant is charged using a cylinder containing the refrigerant, the air conditioner comprising:

a refrigerant circuit having and being configured by the interconnection of a compressor, a heat source side heat exchanger, a utilization side expansion valve, and a utilization side heat exchanger;

a charge port being configured to charge the refrigerant into the refrigerant circuit from the cylinder, the charge port being provided between the utilization side heat exchanger and the compressor of the refrigerant circuit;

a first temperature sensor being provided in the vicinity of the charge port of the refrigerant circuit between the charge port and the compressor;

a charge judging unit being configured to judge whether or not the cylinder is emptied based on a change in at least one of a temperature detected by the first temperature sensor or a superheating degree; and an output unit being configured to output an indication when the charge judging unit judges that the cylinder is emptied, the charge judging unit judging that the cylinder is emptied when a value relating to at least one of a temperature detected by the first temperature sensor or a superheating degree became equal to or greater than a predetermined judgment value.

2. The air conditioner according to claim 1, wherein the first temperature sensor is provided on the downstream side between the charge port and the compressor, a second temperature sensor is further provided on the upstream side with respect to the charge port, and the charge judging unit makes the judgment based on the difference between temperatures or between the superheating degrees detected by the first temperature sensor and by the second temperature sensor, or a change in the difference between the temperatures or between the superheating degrees.

3. The air conditioner according to claim 2, further comprising a state quantity detection sensor configured to detect the state quantity of the refrigerant in the refrigerant circuit, and a refrigerant quantity judging device configured to judge whether or not a predetermined amount of refrigerant has been charged into the refrigerant circuit based on a change in the state quantity detected by the state quantity detection sensor.

4. The air conditioner according to claim 2, further comprising a state quantity detection sensor configured to detect the state quantity of the refrigerant in the refrigerant circuit, and a refrigerant quantity judging device configured to judge whether or not a predetermined amount of refrigerant has been charged into the refrigerant circuit based on a change in the state quantity detected by the state quantity detection sensor.

5. The air conditioner according to claim 1, further comprising a state quantity detection sensor configured to detect the state quantity of the refrigerant in the refrigerant circuit, and a refrigerant quantity judging device configured to judge whether or not a predetermined amount of refrigerant has been charged into the refrigerant circuit based on a change in the state quantity detected by the state quantity detection sensor.

6. An air conditioner in which the refrigerant is charged using a cylinder containing the refrigerant, the air conditioner comprising:

a refrigerant circuit having and being configured by the interconnection of a compressor, a heat source side heat exchanger, a utilization side expansion valve, and a utilization side heat exchanger;

a charge port being configured to charge the refrigerant into the refrigerant circuit from the cylinder;

a first temperature sensor being provided in the vicinity of the charge port of the refrigerant circuit on the downstream side between the charge port and the compressor;

a second temperature sensor provided on the upstream side with respect to the charge port;

a charge judging unit being configured to judge whether or not the cylinder is emptied based on a change in at least one of a temperature detected by the first temperature sensor or a superheating degree; and an output unit being configured to output an indication when the charge judging unit judges that the cylinder is emptied, the charge judging unit judging that the cylinder is emptied when a value relating to at least one of a temperature detected by the first temperature sensor or a superheating degree became equal to or greater than a predetermined judgment value, the charge judging unit making the judgment based on the difference between temperatures or between the superheating degrees detected by the first temperature sensor and by the second temperature sensor, or a change in the difference between the temperatures or between the superheating degrees.

7. The air conditioner according to claim 6, further comprising a state quantity detection sensor configured to detect the state quantity of the refrigerant in the refrigerant circuit, and a refrigerant quantity judging device configured to judge whether or not a predetermined amount of refrigerant has been charged into the refrigerant circuit based on a change in the state quantity detected by the state quantity detection sensor.

8. An air conditioner in which the refrigerant is charged using a cylinder containing the refrigerant, the air conditioner comprising:

a refrigerant circuit having and being configured by the interconnection of a compressor, a heat source side heat exchanger, a utilization side expansion valve, and a utilization side heat exchanger;

a charge port being configured to charge the refrigerant into the refrigerant circuit from the cylinder, the charge port being provided between the utilization side heat exchanger and the compressor of the refrigerant circuit;

a first temperature sensor being provided in the vicinity of the charge port of the refrigerant circuit between the charge port and the compressor;

a charge judging unit being configured to judge whether or not the cylinder is emptied based on a change in at least one of a temperature detected by the first temperature sensor or a superheating degree; and an output unit being configured to output an indication when the charge judging unit judges that the cylinder is emptied.

9. The air conditioner according to claim 8, wherein the first temperature sensor is provided on the downstream side between the charge port and the compressor, a second temperature sensor is further provided on the upstream side with respect to the charge port, and the charge judging unit makes the judgment based on the difference between temperatures or between the superheating degrees detected by the first temperature sensor and by the second temperature sensor, or a change in the difference between the temperatures or between the superheating degrees.

10. The air conditioner according to claim 9, further comprising a state quantity detection sensor configured to detect the state quantity of the refrigerant in the refrigerant circuit, and a refrigerant quantity judging device configured to judge whether or not a predetermined amount of refrigerant has been charged into the refrigerant circuit based on a change in the state quantity detected by the state quantity detection sensor.

11. The air conditioner according to claim 8, further comprising a state quantity detection sensor configured to detect the state quantity of the refrigerant in the refrigerant circuit, and a refrigerant quantity judging device configured to judge whether or not a predetermined amount of refrigerant has been charged into the refrigerant circuit based on a change in the state quantity detected by the state quantity detection sensor.

12. An air conditioner in which the refrigerant is charged using a cylinder containing the refrigerant, the air conditioner comprising:

a refrigerant circuit having and being configured by the interconnection of a compressor, a heat source side heat exchanger, a utilization side expansion valve, and a utilization side heat exchanger;

a charge port being configured to charge the refrigerant into the refrigerant circuit from the cylinder;

a first temperature sensor being provided in the vicinity of the charge port of the refrigerant circuit on the downstream side between the charge port and the compressor;

a second temperature sensor provided on the upstream side with respect to the charge port;

a charge judging unit being configured to judge whether or not the cylinder is emptied based on a change in at least one of a temperature detected by the first temperature sensor or a superheating degree; and an output unit being configured to output an indication when the charge judging unit judges that the cylinder is emptied, the charge judging unit making the judgment based on the difference between temperatures or between the superheating degrees detected by the first temperature sensor and by the second temperature sensor, or a change in the difference between the temperatures or between the superheating degrees.

* * * * *